US007563165B2

(12) United States Patent
Seelig et al.

(10) Patent No.: US 7,563,165 B2
(45) Date of Patent: Jul. 21, 2009

(54) GAMING DEVICE WITH ACTION UNIT DISPLAY AND METHOD OF USE

(75) Inventors: Jerald C. Seelig, Absecon, NJ (US); Lawrence M. Henshaw, Hammonton, NJ (US)

(73) Assignee: Atlantic City Coin & Slot Service Company, Inc., Pleasantville, NJ (US)

( * ) Notice: Subject to any disclaimer, the term of this patent is extended or adjusted under 35 U.S.C. 154(b) by 357 days.

(21) Appl. No.: 11/470,597

(22) Filed: Sep. 6, 2006

(65) Prior Publication Data

US 2007/0026948 A1 Feb. 1, 2007

Related U.S. Application Data

(63) Continuation-in-part of application No. 10/883,489, filed on Jun. 30, 2004, now Pat. No. 7,258,610.

(60) Provisional application No. 60/716,792, filed on Sep. 13, 2005.

(51) Int. Cl.
*G07F 17/34* (2006.01)

(52) U.S. Cl. ..... 463/20; 463/46; 463/25; 463/26; 463/27; 273/143 R; 273/138.1; 273/144 R; 273/144 A; 273/144 B

(58) Field of Classification Search ..... 273/143 R, 273/138.1, 144 R, 144 A, 144 B; 463/20, 463/46, 25, 26, 27
See application file for complete search history.

(56) References Cited

U.S. PATENT DOCUMENTS

| | | | | | |
|---|---|---|---|---|---|
| 1,994,977 | A * | 3/1935 | Benson | 273/144 B |
| 4,871,171 | A * | 10/1989 | Rivero | |
| 5,380,007 | A * | 1/1995 | Travis et al. | |
| 5,848,932 | A * | 12/1998 | Adams | |
| 5,919,088 | A * | 7/1999 | Weiss | 463/9 |
| 6,032,955 | A * | 3/2000 | Luciano et al. | 273/138.1 |
| 6,322,071 | B1 * | 11/2001 | Chaaban | 273/138.4 |

* cited by examiner

*Primary Examiner*—Benjamin H Layno
(74) *Attorney, Agent, or Firm*—Ian F. Burns & Associates, P.C.

(57) ABSTRACT

A gaming device having a reservoir for holding a plurality of display objects, an emptying mechanism for causing the display objects to fall out of the reservoir, an actuator for activating the emptying mechanism, and a controller configured to activate the actuator, is disclosed. The gaming device may further include a display area and a display object transport device to move the display objects from the display area to the reservoir. The reservoir of the gaming device may simulate a bank vault where the display objects further simulate coins as they fall out of the bank vault. A gaming method involving the aforementioned device is also disclosed.

18 Claims, 30 Drawing Sheets

FIG. 15E
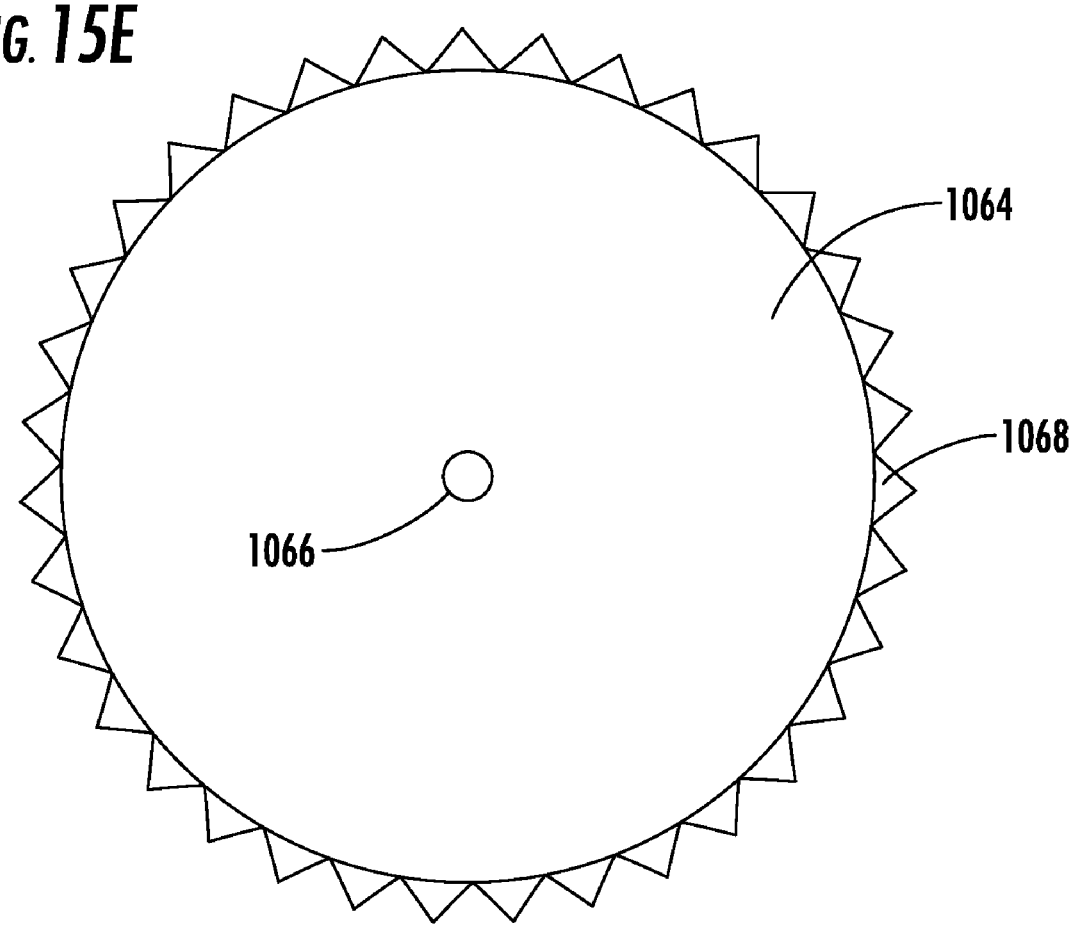
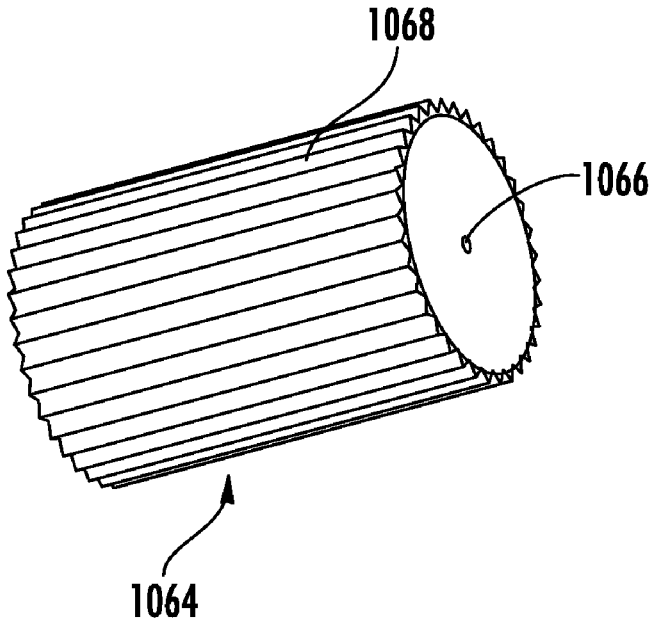
FIG. 15F

GAMING DEVICE WITH ACTION UNIT DISPLAY AND METHOD OF USE

CROSS REFERENCES TO RELATED APPLICATIONS

This application is a continuation-in-part application of U.S. patent application Ser. No. 10/883,489 filed Jun. 30, 2004. This application also claims priority to U.S. provisional patent application No. 60/716,792, filed Sep. 13, 2005. All of the above referenced applications are hereby expressly incorporated by reference in their entireties.

BACKGROUND OF THE INVENTION

The present invention relates to a gaming device and a method of use. More specifically, the gaming device includes a display device configured to hold display objects in a reservoir where the display objects subsequently fall out of the reservoir into a display area upon activation of a reservoir emptying mechanism.

Gaming Devices

Gaming devices are well known in the art and a large variety of gaming devices have been developed. In general, gaming devices allow users or players to play a game. In many casino-type gaming devices, the outcome of the game depends, at least in part, on a randomly generated event. For example, a gaming device may use a random number generator to generate a random or pseudo-random number. The random number may then be compared to a predefined table to determine the outcome of the event. If the random number falls within a certain range of numbers on the table, the player may win a predefined prize. The table may also contain display information that allows the gaming device to generate a display that corresponds to the outcome of the game. The gaming device may present the outcome of the game on a large variety of display devices, such as mechanical spinning reels or video screens.

Bonus Prizes

Some gaming devices award bonuses in addition to prizes that are awarded in the primary game. A bonus can be defined as an additional prize that is awarded to the player when a predefined event occurs. An example of a bonus game can be found in U.S. Pat. No. 5,848,932 issued to Adams. One of the gaming devices described in this document comprises three spinning reels and a spinning wheel bonus display. When predetermined indicia are displayed on the spinning reels of the primary game, the wheel can be activated to indicate a bonus prize. The bonus prize is awarded in addition to any prizes awarded in the primary game.

In another embodiment described in this document, the gaming device includes a container having one or more movable objects and a transport device for transporting the one or more movable objects within the container. When predetermined symbols are displayed on the reels of the primary game, the transport device can be activated to transport the movable objects while the player is allowed to play the bonus game.

Generally, bonus prizes are offered in such games in order to increase the excitement and enjoyment experienced by players. This attracts more players to the game and encourages players to play longer. When gaming devices attract more players and the players play longer, they tend to be more commercially successful relative to other gaming devices.

Display Devices

In addition, highly visible display devices are utilized on gaming devices in order to attract players. Once players are attracted to the gaming device, they tend to play longer because the display device enhances the stimulation and excitement experienced by players. It is, therefore, desirable for gaming devices to incorporate highly visible display devices.

The applicants believe that display devices tend to be more successful if they are a derivation of a well-known game or theme. They are more successful because players tend to be drawn to games that they instantly recognize. Many players are reluctant to try completely new games because they must spend time to learn the new game. It is, therefore, desirable to provide display devices that are based on well-known games or themes.

The applicants also believe that display devices tend to be more successful if they utilize physical objects rather than altered reproductions of the physical objects. For example, although video devices and electronic signs can be used for display devices, players are more attracted to display devices that utilize physical objects. Physical objects can be even more effective display devices if they are moveable and they are used in combination with lights and sounds. With the movement of objects within display devices, it is advantageous to use transport devices that will attain maximum effectiveness while occupying a minimum amount of space. It is important to minimize the amount of occupied space because a smaller gaming device generally corresponds to an overall lower cost.

Keno

Upon an initial examination, it would appear to the applicants that the display device of Keno is an excellent choice for a display device for gaming devices. Keno is well known to the playing public, and it utilizes a highly visible and attractive display device. The display device comprises a container with a plurality of numbered balls. The balls in the container are agitated or jumbled, usually by a jet of air, to a state where they ricochet off of the walls of the container.

In the game of Keno, players select numbers that maybe drawn from the Keno display device. The display device jumbles or mixes numbered balls in the container and then draws a predetermined number of balls from the container. Players are paid based on the number of balls drawn from the display device that match the numbers they selected.

However, before the present invention, the Keno display device has been unsuitable for use with gaming devices. One of the reasons this is so is because Keno is susceptible to environmental influences. An important aspect of any gaming device is resistance to environmental influences that could affect the results of the game. However, as the balls are jumbled in the Keno ball device, static electricity, dust, and contaminants build up on the balls. This may cause the balls to stick to each other or to components in the display device thereby influencing the randomness of the game. Furthermore, the balls used in Keno displays may have slightly different weights or sizes that subtly affect the outcome of the game.

Another reason the game of Keno has been unsuitable as an indicator for a gaming device is that it requires a great deal of human involvement. In many Keno games, human operators are required to read the numbers of the Keno balls as they are selected and input the numbers into a computer or display. Furthermore, operators must regularly clean the Keno balls and the Keno devices to keep dust and contaminants from building up on the balls. Not only does this require far too much human involvement for an automated gaming device (the greater the human involvement, the greater the cost of operating the game), the game is also susceptible to tampering and cheating.

Because of their susceptibility to environmental influences and tampering and their dependence on human operators and maintenance personnel, Keno games are not allowed in at least one major gaming jurisdiction. Furthermore, these disadvantages have prevented Keno display devices and other devices that use jumbled balls from being configured for use with gaming devices. The applicants have discovered that what has long been needed is a means for configuring jumbled ball display devices for use with gaming devices. Although reference is made to the game of Keno, it is to be understood that the present invention may be used with almost any type of ball, jumbled ball, or action unit display device, such as lottery balls for example.

Jumbled Ball Displays

Two references that disclose use of jumbled ball displays are U.S. Pat. No. 4,871,171 issued to Rivero and U.S. Pat. No. 5,380,007 issued to Travis et al. Rivero appears to disclose a game device with means for simulating the release of a ball. In this reference, a rotating drum 2 is provided with numbered balls 17. As the drum rotates, a ball is released into a transparent tube 16.

However, Rivero is not intended to show the player the ball that is released from the drum. Rather, the ball is held in the tube, out of view of the player, and an electronic reproduction of the ball number is presented in a window 9. This is intended to give the player "the impression" that the ball has been counted. Rivero fails to disclose or suggest displaying actual balls to the player to indicate the outcome of the game or the value of a prize. In addition, in the Rivero device the balls are in a cage and quite exposed to the environment and tampering. The ball cage of Rivero is also mounted on the front side and well below the top of the gaming machine, hiding the ball cage from view of potential game players who are not in position to see the front side of the machine.

Travis et al. appear to disclose a video lottery gaming device with numbered balls 48. However, all of the balls are reproductions generated by software and no physical balls are displayed to the player. Travis et al. also fails to disclose or suggest displaying actual balls to the player to indicate the outcome of the game or the value of a prize.

One of the disadvantages with Rivero and Travis et al. is that no actual physical balls are used to display the outcome of a game. This is less desirable because players like to see physical objects rather than electronic reproductions of the physical objects. Moreover, players tend to believe that a game device is misleading when the device purports to display a reproduction of an object rather than the object itself. This is especially true when the object itself is supposedly available for viewing, as is the case in Rivero.

U.S. Pat. No. 6,032,955 issued to Luciano et al. appears to disclose a progressive wagering system in which at least a portion of a progressive jackpot is displayed with prize objects. A bank is provided for storing, displaying and dispensing the prize objects. Tangible prize objects are dispensed to the player via a control device when the player has won a progressive prize.

BRIEF SUMMARY OF THE INVENTION

The present invention provides a gaming device comprising a plurality of display objects; a reservoir configured to hold at least one display object; a reservoir emptying mechanism associated with the reservoir, the emptying mechanism being configured to cause the display objects to fall out of the reservoir; an actuator mechanism coupled to the reservoir emptying mechanism, the actuator mechanism being configured activate the reservoir emptying mechanism to cause the display objects to fall out of the reservoir; and a controller in communication with the actuator mechanism, the controller being configured to activate the actuator mechanism. Gaming devices of the present invention may further comprise (in addition to that described above): a plurality of prize objects; a prize object holder configured to hold the prize objects in an individually controlled manner; and a display mechanism associated with the prize object holder and configured to selectively display at least one prize object to a player. In one embodiment, the display objects are not indicative of, nor do they correspond to, the prize objects that may be awarded to a player; accordingly, the display objects and prize objects are separate and distinct from each other in this embodiment.

The present invention further provides a gaming device having a first display area comprising the gaming device described above and a second display area comprising: a plurality of prize objects; a prize object holder configured to hold the prize objects in an individually controlled manner; a display mechanism for selectively displaying at least one prize object; and a controller in communication with the display mechanism, the controller being configured to select a prize object and cause the display mechanism to display the selected prize object to a player. Typically, the display objects of the first display area are located separately from the prize objects of the second display area; in addition, the prize objects held in the prize object holder may be hidden from view of the player.

The present invention also provides a gaming device comprising: at least one game apparatus configured to allow a player to play a game; and at least one controller in communication with a display device, the controller being configured to determine a random game outcome, and wherein the display device comprises a reservoir configured to simulate a bank vault. This embodiment may further include a plurality of display objects configured to simulate coins. Typically, this embodiment may also involve the controller being configured to detect a bonus qualifying event and activate a bonus game cycle.

The present invention provides a method of display comprising the following steps, but not all necessarily in the order listed: storing a plurality of display objects in a reservoir; activating a reservoir emptying mechanism associated with the reservoir; and allowing the display objects to fall out of the reservoir into a display area, the display area being visible to the player. The method may further comprise: deactivating the reservoir emptying mechanism, transporting the display objects from the display area to the reservoir, and refilling the reservoir with display objects. In another embodiment, the method may further comprise allowing a display object transport device to move display objects from the display area to the reservoir for a predetermined time after activating the reservoir emptying mechanism to provide a continuous flow of display objects falling out of the reservoir for the predetermined time.

For purposes of the present invention, "determining (or determination of) a game outcome" shall mean actively causing, deciding, dictating, choosing, selecting or affecting the outcome of the game. This is in contrast to detecting, learning, identifying, discovering, ascertaining or finding out the result of the game outcome.

The above description sets forth, rather broadly, a summary of some embodiments of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

The various embodiments of the present invention may, but do not necessarily, achieve one or more of the following advantages:

the ability to provide game players with a more exciting and desirable gaming experience;

the ability to attract more patrons to play a game;

provide longer play times and a greater payout possibility for a player;

provide greater revenues for gaming operators;

provide a gaming device that utilizes a visually appealing and highly visible display device;

provide a gaming device including a transport device occupying a minimal amount of space; and provide a gaming device with a bonus activating event where the display objects simulate coins and the display device simulates bank vault for activation during a bonus game cycle.

These and other advantages may be realized by reference to the remaining portions of the specification, claims and abstract.

BRIEF DESCRIPTION OF THE DRAWINGS

FIG. 15E is a cross-sectional view of another embodiment of a transport device useful in the present invention.

FIG. 15F is a front perspective view of the transport device in FIG. 15E.

DETAILED DESCRIPTION OF THE INVENTION

In the following detailed description of various embodiments, reference is made to the accompanying drawings, which form a part of this application. The drawings show, by way of illustration, specific embodiments in which the invention may be practiced. It is to be understood that other embodiments may be utilized and structural changes may be made with out departing from the scope of the present invention.

In the Detailed Description below, the applicants utilize various spatially orienting terms such as "upper," "lower," "horizontal" and "vertical." It is to be understood that these terms are used for ease of description of the various embodiments with respect to the drawings but are not necessarily in themselves limiting or requiring of an orientation as thereby described in the following Detailed Description.

Figure 1A:
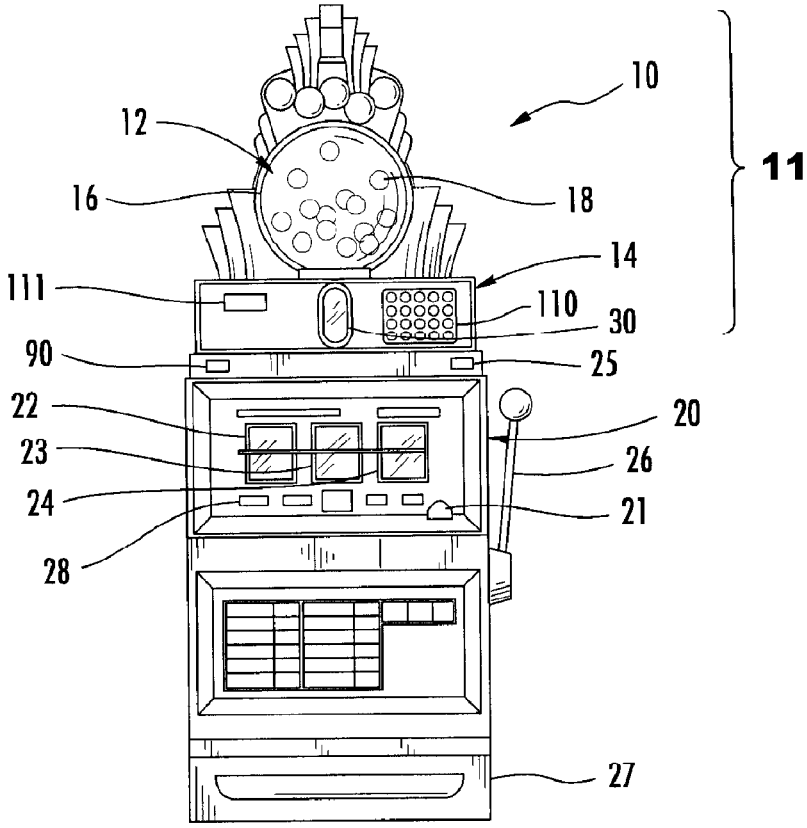
FIG. 1A is substantially a front view of a gaming device useful in the present invention.

As seen in FIG. 1A, one embodiment disclosed herein comprises a gaming device, generally indicated by reference number 10. Gaming device 10 comprises a display device 11 and a game apparatus 20. Display device 11 may comprise a jumbled ball display 12 and a prize display 14. Display device 11 may also include display window 30, player input device 90, display 110 and dispenser 111.

Game Apparatus

With continuing reference to FIG. 1A, game apparatus 20 may be any of a large number of devices that are configured to allow players to play a game. For example, game apparatus 20 may utilize reel displays, such as spinning reels 22-24 or a video display (not shown), to display outcomes of the game. Means may also be provided for accepting wagers, such as a coin slot 21 or card reader 25, and for awarding prizes, such as a coin dispenser 27. A handle 26 and button 28 are provided for activating game apparatus 20 to begin a game. In at least one embodiment, game apparatus 20 may be an S Plus™ model gaming device manufactured by International Game Technology in Reno, Nev.

Game apparatus 20 is typically controlled by an electronic controller 82 (see FIG. 2A) that utilizes a random number generator. The random number generator produces a random or pseudo random number for each game. The outcome of the game may be determined by comparing the random number to a table of outcomes stored in a memory and accessed by controller 82. A number of different tables of outcomes may be used and different tables may be used for different games. The tables can be designed so that different prizes have different probabilities of being awarded. Such design techniques are well known in gaming. Examples of such designs are shown in U.S. Pat. No. 4,448,419, issued to Telnaes, and U.S. Pat. No. 5,456,465, issued to Durham. Controller 82 causes spinning reels 22-24 of the video display to show the outcome of the game that corresponds to the outcome of the random number generator. It is understood that game apparatus 20 may operate in many other ways and still achieve the objects of the present invention.

Game apparatus 20 may also be capable of producing a bonus-activating event. This event may be many different types of events. For example, a bonus-activating event may comprise displaying a particular symbol, such as a "bonus" symbol, or combination of symbols, such as three "7" symbols, on reels 22-24. If the game being played is poker based, the bonus-activating event may be occurrence of a certain hand, such as a royal flush. Furthermore, a bonus-activating event may occur when a player accumulates a number of symbols or game outcomes over a number of separate game plays. For example, a bonus-activating event may occur when the player receives three "bonus" symbols during a period of time. The bonus-activating event may be based on an external event. For example, a bonus-activating event may occur when a group of players obtain a certain result.

Jumbled Ball Display

With continuing reference to FIG. 1A, jumbled ball display 12 comprises a container 16 that is configured to hold a plurality of display balls 18. Container 16 is at least partially transparent allowing players to view display balls 18 inside of the container. Container 16 is made of a transparent material, such as plastic or glass. In one embodiment, container 16 is made of acrylic. Suitable containers of this type may be obtained from Tripp Plastics of Reno, Nev. However, container 16 may also be a wire cage of a type that is used in some Keno games.

Container 16 may have many different shapes, such as a sphere, cube, cylinder or triangle, for example. In one embodiment, container 16 is substantially spherical with a partially flat back (not shown). The flat back allows container 16 to be large while still allowing gaming device 10 to placed against a wall, another gaming device, or other objects.

Although display balls 18 are typically similar to keno balls, many other types of balls may be used. For example, display balls 18 may be ping-pong balls or rubber balls. Display 12 also comprises an agitator (not shown in FIG. 1) to agitate or jumble display balls 18 within container 16. The agitator may be a stream of air or a mechanical mixing device. The agitator causes the balls to bounce and ricochet off of the walls of container 16. In one embodiment, a stream of air is used as an agitator and container 16 comprises an off center opening for the stream of air. The opening is off center to increase the initial agitation of display balls 18.

Fins (not shown) may also be provided at the bottom of container 16 to help agitate display balls 18. The fins support display balls 18 when they are resting at the bottom of container 16. This helps air circulate underneath display balls 18 to lift and separate the balls.

The purpose of jumbled ball display 12 is to attract and entertain players. When display balls 18 are agitated, they produce a vivid display that attracts the attention of people nearby and provides an exciting display for players playing gaming device 10. Display balls 18 are typically kept separate from balls used in display device 14.

Figure 1B:
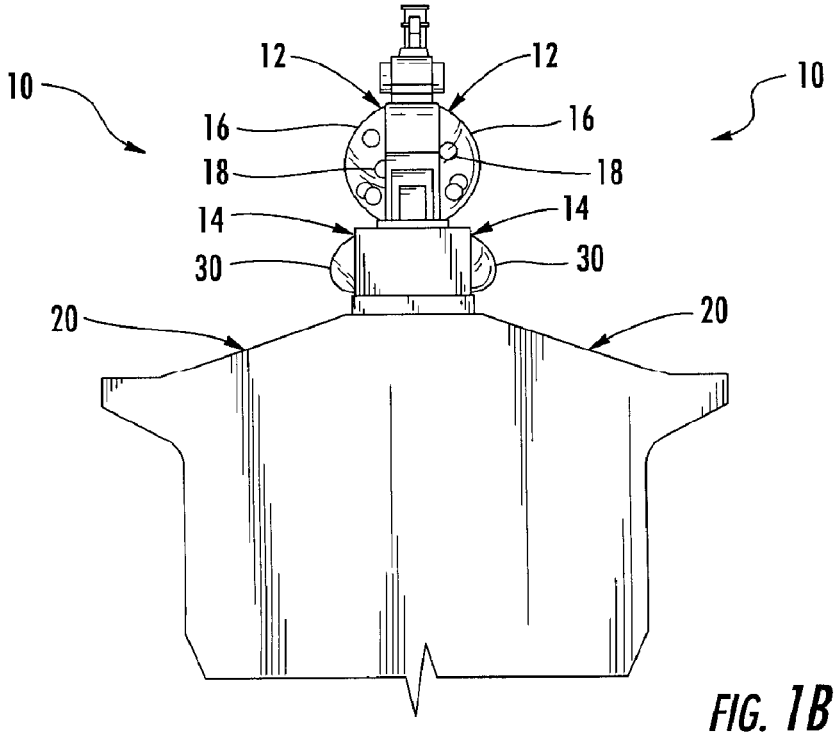
FIG. 1B is substantially a side view of an alternative embodiment of a gaming device.

FIG. 1B represents an alternative embodiment of the present invention in which two gaming devices 10 are placed back to back. Each gaming device 10 comprises a game apparatus 20. Game apparatuses 20, shown in FIG. 1B are known as "slant top" models for their sloping upper surfaces. However, other types of gaming devices, such as the upright game apparatus 20 shown in FIG. 1A, may also be used. In this embodiment, a separate jumbled ball display 12 is provided for each game apparatus 20. Each jumbled ball display 12 may comprise container 16 in the shape of a hemisphere. Containers 16 may be placed back to back so that the two containers have a spherical appearance when viewed from the side. Other shapes, such as cubes and cylinders, may also be used. A mirror may be placed at the back of each container 16 to enhance the appearance of the jumbled ball displays 12 by reflecting images of jumbled display balls 18 outward toward the players. Containers 16 may also be one single container that is divided in two by a mirror or other partition. Each container 16 has its own independently operated agitator and jumbled display balls 18. Each game apparatus 20 has its own independently operated prize display 14 with display window 30.

Prize Display

Referring to FIGS. 1A and 1B, prize display 14 is configured to select a prize ball and display the ball to a player. When a bonus-activating event occurs, prize display 14 senses this, selects a prize ball, and displays the ball in a display window 30.

Figure 2A:
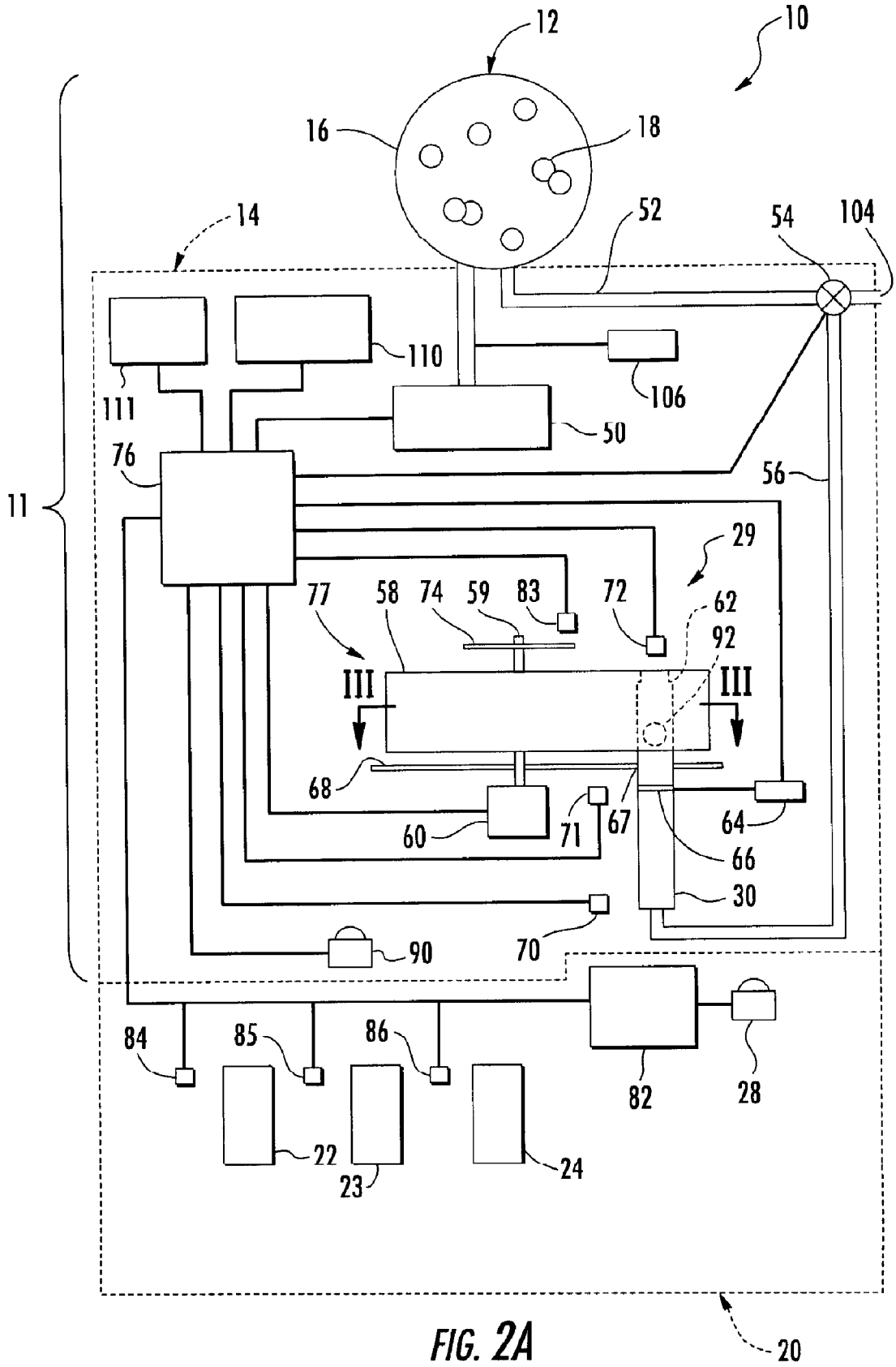
FIG. 2A is substantially a schematic diagram of a gaming device useful in the present invention.

Turning now to FIG. 2A, prize display 14 comprises a controller 76 that is configured to control the operation of the device. Controller 76 may be one or more computers or processor boards. For example, in the presently implemented embodiment, controller 76 comprises a bonus controller and stepper motor controller, which may be manufactured by Progressive Solutions in Carmichael, Calif., a core module by Z-World in Davis, Calif., and a sound board by Clever devices in Syosset, N.Y. Other, equally suitable devices may be purchased from other manufacturers. It is understood that controller 76 may be a single processor or processor board.

Furthermore, it is also understood that controller 76 and controller 82 may be combined in a single processor or processor board.

Controller 76 is configured to detect when a bonus activating event occurs in game apparatus 20. This may be accomplished by game apparatus controller 82 transmitting a signal to controller 76 that a bonus event has occurred. For example, controller 82 may determine the outcome of each game and when a bonus-activating outcome occurs, it transmits a signal to controller 76. Alternatively, controller 76 may periodically interrogate controller 82. In another embodiment, one or more sensors may be provided for determining if a bonus activating event has occurred. For example, sensors 84-86 may sense the positions of reels 22-24. When reels 22-24 are in a bonus activating position, controller 76 would sense this position and begin a bonus sequence (described below). Sensors may also be provided external to gaming device 10 to detect external bonus-activating events.

Controller 82 may also transmit a variety of information to controller 76. For example, controller 82 may signal when coins or currency have been inserted, when a game starts, when an error has occurred, and when a sensor detects tampering.

When controller 76 detects a bonus-activating event, it may begin a bonus sequence by activating display 110. Display 110 may comprise many different kinds of display devices, such as video screens, lights and light emitting diodes (LED), for example. Display 110 may comprise its own controller that is configured to generate a variety of displays.

Display 110 may indicate that a player has qualified for a bonus round and prompt the player to perform an action. In one embodiment, the player is prompted to activate the bonus sequence by pressing input device 90. Input device 90 may be a simple button, a keyboard, or a touch screen display. In the embodiment in which the player must accumulate a number of bonus symbols to qualify for a bonus, display 110 may indicate the number of symbols the player has received.

When controller 76 detects input device 90 being activated, the controller would activate the agitator in jumbled ball display 12. In one embodiment, the agitator comprises blower 50, which blows air into container 16. Alternatively, the agitator may begin automatically and input device 90 may be used to initiate the display sequence. In another embodiment, controller 76 may wait a predetermined time period for the player to activate input device 90. If the player does not activate input device 90 in that time period, controller 76 would automatically activate the display 12 and initiate the display sequence. In yet another embodiment, controller 76 automatically initiates the display sequence in a predetermined time period, independent from input device 90, and input device 90 is only used to activate the jumbled ball display 12. It is understood that no input device may be used and controller 76 may automatically activate display 12 and begin the display sequence.

To display a prize ball, controller 76 performs a routine to determine which ball will be displayed. This may be performed by a number of methods that are well known in the art. For example, prize balls 92 may be sequentially displayed or displayed based on external events, such as certain bonus activating events may always cause the same prize ball to be displayed.

In a typical embodiment, however, prize balls 92 are randomly selected. Controller 76 generates a random number and then compares the random number to a pay table similar to that described for game apparatus 20 or as described in U.S. Pat. No. 5,823,874, issued to Adams. A simple pay table may appear as follows:

TABLE 1

| Random Number | Prize Ball Number | Amount Paid |
|---|---|---|
| 0.00 to 0.50 | 1 | $1.00 |
| 0.51 to 0.75 | 2 | $5.00 |
| 0.76 to 0.95 | 3 | ×2 |
| 0.96 to 1.00 | 4 | $1,000.00 |

For example, if the random number generator produced 0.65, prize ball number 2 would be displayed and $5.00 would be awarded to the player. If the random number generator produced 0.80, prize ball number 3 would be displayed. Prize ball number 3 is a multiplier ball that multiplies some amount produced by game apparatus 20. Gaming apparatus 20, for instance, may award $20 and the multiplier ball would multiply this by two, awarding the player $40.

This embodiment is not necessarily limited to the example pay table shown. A greater number of prize balls may be used, and, as will be discussed below, a combination of prize balls may be displayed. Furthermore, different kinds of prizes, besides monetary prizes, may be awarded. For example, the prizes may be goods, services or additional games. The goods and services may be awarded in the form of physical objects, tickets, vouchers or coupons, for example. Additional games may be presented in the form of tickets, such as scratch off lottery tickets. In the embodiments in which tickets, vouchers, and coupons are used, the objects are dispensed using an internally or externally mounted dispenser 111. Such dispensers are well known in the art.

Once controller 76 determines the prize ball to be displayed and the prize to be awarded, the controller activates a positioning mechanism 77. Positioning mechanism 77 is configured to position a selected prize ball (that is separate from display balls 18) so that it can be displayed. Positioning mechanism 77 may utilize a large variety of devices to achieve its purpose. In a typical embodiment, all of the prize balls are held in a ball holder 58. Ball holder 58 may be made from a variety of materials, such as plastics, metals, or composites. In one embodiment, ball holder 58 is cast high-density urethane foam that is machined to obtain a precise shape. In one embodiment, ball holder 58 is injection molded plastic.

Prize balls 92 typically have a similar appearance to display balls 18 in container 16. This creates the illusion that balls displayed in display window 30 originate from container 16. At least one of prize balls 92 have a symbol that is capable of indicating a prize to be awarded to the player.

Prize balls 92 are stored in ball holder 58 in an individually controlled manner so that individual balls can be selectively removed from the ball holder. This allows particular balls with particular symbols or values to be individually manipulated and displayed when desired. This may be accomplished in different ways. In one embodiment, ball holder 58 comprises a chamber 62 for each prize ball 92 stored in the holder. A display mechanism 29 is provided for removing ball 92 stored in chamber 62, displaying the ball, and replacing it in the chamber.

Figure 3:
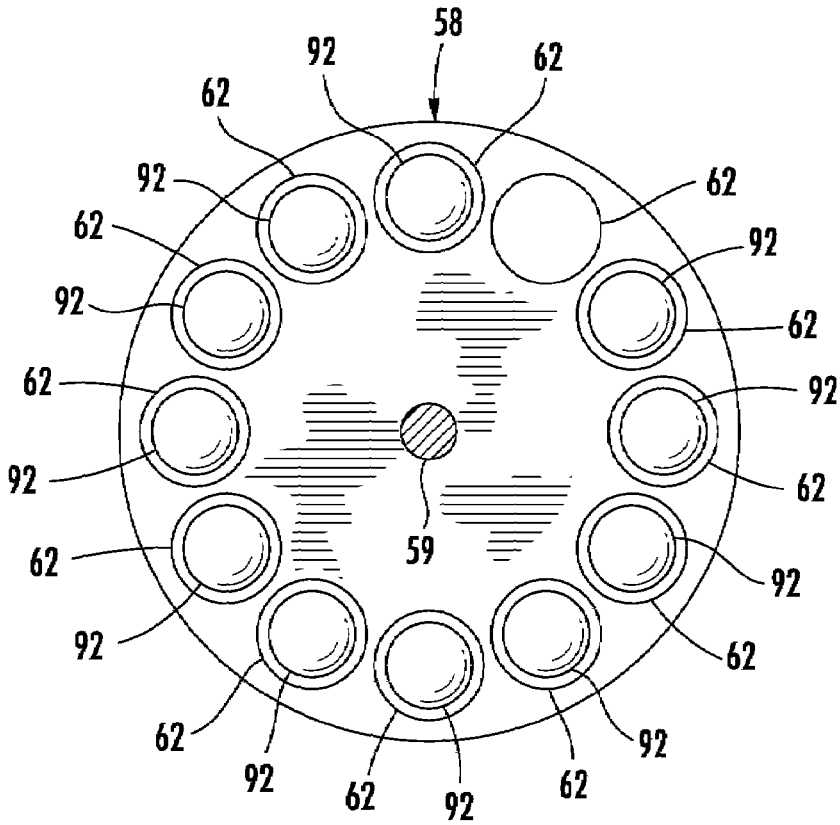
FIG. 3 is substantially a top cross sectional view of one embodiment of a ball holder taken along line III in FIG. 2A.
Figure 4:
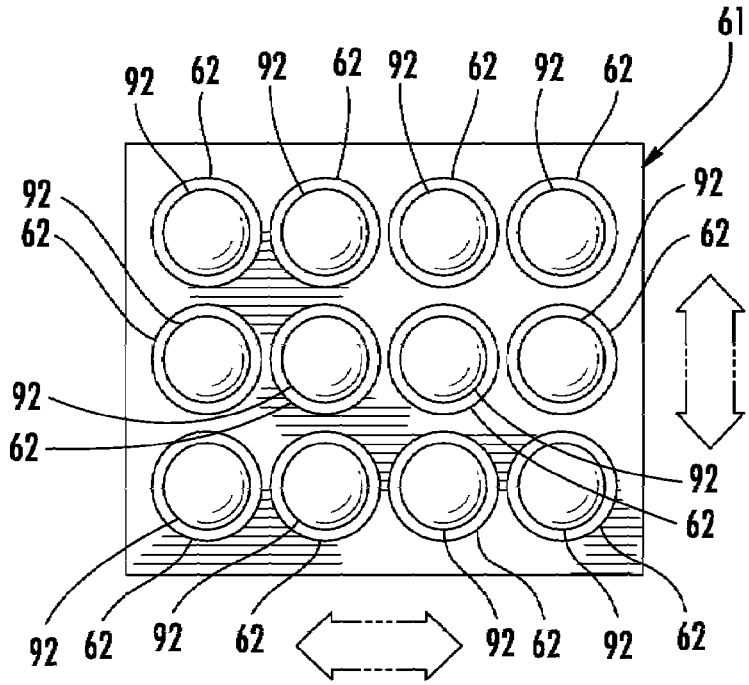
FIG. 4 is substantially a top cross sectional view of an alternative ball holder useful in the present invention.

In one embodiment, ball holder 58 is cylindrical as illustrated in FIG. 3. Chambers 62 are positioned outward from a central axis 59 of ball holder 58, near the periphery of the holder. Thus, chambers 62 maybe positioned by rotating ball holder 58 around its central axis 59. Ball holder 58 maybe provided in different configurations. For example, as shown in FIG. 4, ball holder 61 may be square or rectangular with chambers 62 arranged in rows and columns. In this embodiment, controller 76 is programmed with the location of chambers 62 and ball holder 61 is positioned by moving it laterally and longitudinally. Stepper motors and gears may perform the lateral and longitudinal positioning (not shown).

Returning to FIG. 2A, positioning mechanism 77 comprises a stepper motor 60 for rotating holder 58. Wheel 74, rigidly attached to holder 58, and sensor 83, not attached to the holder, are provided for determining the angular position of the holder. Thus, controller 76 can position a ball 92 in holder 58 where it can be removed and replaced by rotating the holder and monitoring its angular position. The angular position of each prize ball 92 is stored in memory in controller 76. Sensor 83 may be an infrared source and detector and the periphery of wheel 74 may comprise portions with different reflective characteristics, such as physical holes or gaps or absorbent paint lines. Alternatively, an optical flag configuration similar to that described in U.S. Pat. No. 4,911,449, issued to Bertram, may be used.

Figure 5A:
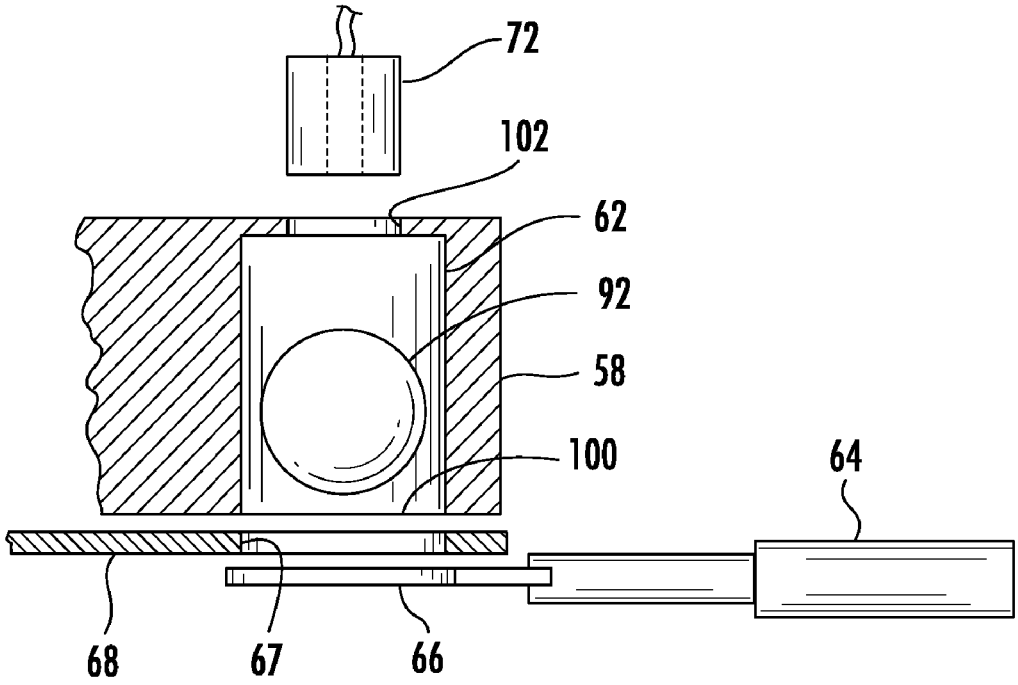
FIG. 5A is substantially an enlarged view of the ball holder shown in FIG. 2A.

In one embodiment, holder 58 is arranged to allow the force of gravity to remove balls 92 from the holder. Referring now to FIGS. 2A and 5A, each chamber 62 has a lower opening 100 that is large enough for prize ball 92 to pass through. A plate 68 is provided on the lower surface of holder 58 for preventing prize balls 92 from falling out of chambers 62. A hole 67 is provided in one portion of plate 68 for allowing ball 92 to pass through the plate. A gate 66 blocks ball 92 until it is opened by an actuator 64. Gate 66 may cover the entire hole 67 or just a portion of it and it may be operated in a sliding or hinged manner. Actuator 64 may be an electrical solenoid actuator.

Figure 5B:
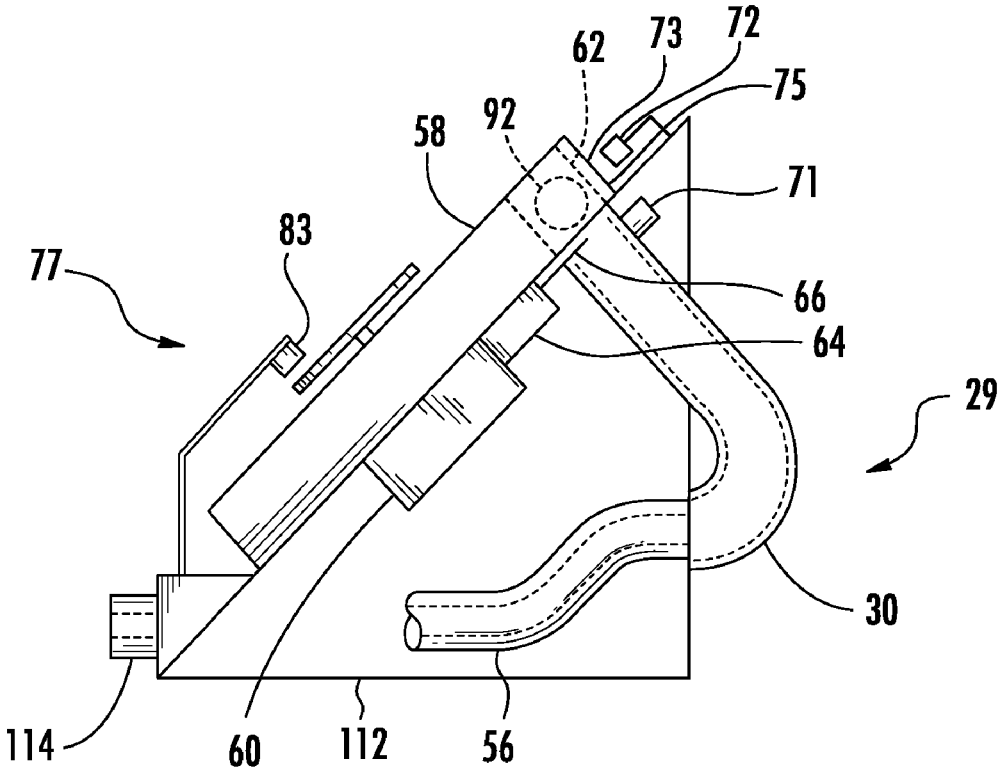
FIG. 5B is substantially a side elevational view of positioning and display mechanisms useful in the present invention.

FIG. 5B represents one embodiment in which a chassis 112 supports ball holder 58 at approximately a forty-five degree angle to the vertical. Mounting grooves (not shown) may be provided in prize display 14 for slidably receiving chassis 112 and connector 114 may be provided for connecting electrical circuits and devices to power supplies and controller 76. One of the advantages of this embodiment is that positioning mechanism 77 and display mechanism 29 can be easily serviced by removing chassis 112 from prize display device 14.

Referring to FIGS. 2A and 5A, in normal operation, after controller 76 has determined which ball is to be displayed, the controller rotates holder 58 until the desired prize ball 92 is positioned over the plate hole 67. At the appropriate time, controller 76 activates actuator 64 to open gate 66. The force of gravity then pulls prize ball 92 downward through hole 67 into display window 30. Display window 30 may be a chamber with a transparent or partially transparent wall that allows the player to see selected prize ball 92. In one embodiment, display window 30 comprises a tube that projects outward from the front surface of prize display device 14. This allows players to view prize ball 92 from many different angles and see symbols on the ball. Sensors 70 and/or 71 may be used to verify that prize ball 92 has fallen into display window 30. If sensors 70 and/or 71 do not detect ball 92 in its proper position, controller 76 may enter an error mode.

If the ball is detected in its proper position, controller 76 may cause display 110 to display the prize, if any, that the player has won. Other effects may also be presented, such as pre-recorded sound from speakers. If the actual prize is money, the amount of the prize may be added to the player's credit meter or the prize may be dispensed from dispenser 111 or coin dispenser 27.

After ball 92 has been displayed long enough, controller 76 operates a valve 54 to divert exhaust air from container 16. While blower 50 is in operation, air is allowed to escape container 16 through an exhaust duct 52. Valve 54 is used to divert air from a vent 104 to a display duct 56. Display duct 56 directs air to the bottom of display window 30 where it blows the ball 92 upwards back into chamber 62. An upper opening 102 is provided in chamber 62 for allowing air to escape from the chamber thereby producing an air current. Sensors 72 and/or 71 may be used to verify that ball 92 has returned to chamber 62. If the ball is not detected in its proper position, controller 76 may enter an error mode and an attendant is called. In one embodiment, shown in FIG. 5B, sensor 72 is placed next to the peripheral wall 75 of ball holder 58 and a hole 73 is provided in the peripheral wall next to each chamber 62.

Components may be arranged alternatively so that ball display window 30 is located above holder 58 and ball 92 is blown upwards into the display. When valve 54 is closed, the force of gravity pulls ball 92 back into chamber 62. In this alternate embodiment, once ball 92 has returned to chamber 62, controller 76 closes gate 66 by activating actuator 64, turns off blower 50, and waits for the next activating event.

A power failure or power surge could cause actuator 64 to malfunction and improperly open gate 66 while prize display 14 is idle. This would cause prize ball 92 to fall out of chamber 62 into display window 30, thereby giving a false indication that the player had won a prize. In order to prevent this, in one embodiment, at least one chamber 62 does not have prize ball 92 (see FIG. 3). This empty chamber is positioned over hole 67 whenever prize display 14 is idle.

It is understood that other methods for agitating display balls 18 may be provided. In addition, other methods for actuating and displaying prize balls 92 may be used. The present invention is not limited to any particular method or apparatus for agitating or displaying display balls 18 and/or prize balls 92.

For example, in certain embodiments, including embodiments discussed further below, display balls 18 may be agitated by actuation of jumbled ball display 12. If display balls 18 are agitated by actuation of jumbled ball display 12, it may be desirable to employ other methods of actuating and displaying prize balls 92. For example, if an air compressor is not needed for agitation of display balls 18, it may be beneficial to modify the method of displaying prize balls 92 so that the air compressor may be eliminated from game apparatus 20.

Figure 2B:
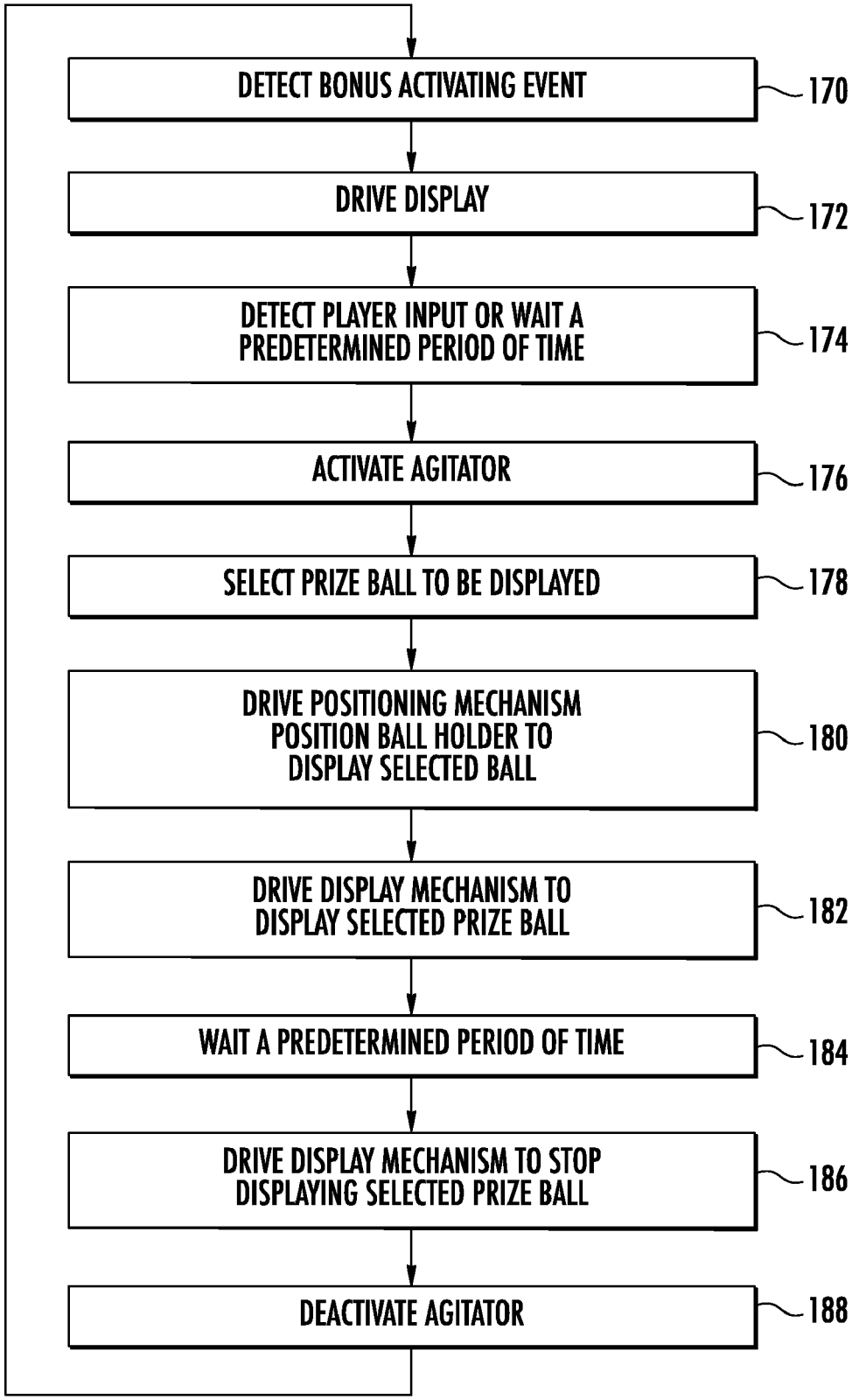
FIG. 2B is substantially a flow chart showing one of the many ways the display device may be operated.
Figure 2C:
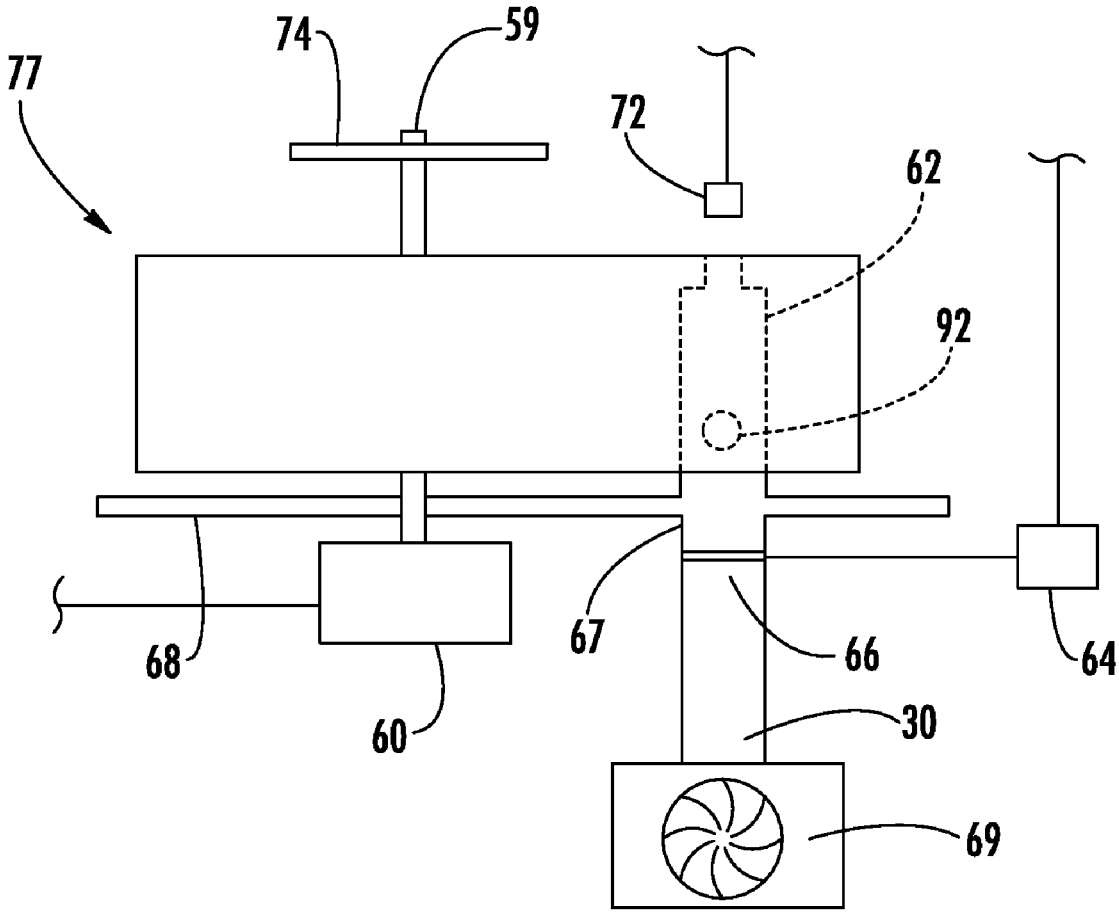
FIG. 2C is substantially a schematic diagram of one embodiment of a prize ball display mechanism for use in the gaming device of FIG. 2A.

For example, as illustrated in FIG. 2C, rather than opening valve 54 to divert air to display duct 56 (as in FIG. 2A), an air source or blower can be located below display window 30. For example, a fan 69 may be placed below display window 30. When activated by controller 76, fan 69 operates and creates a stream of air that blows display ball 92 in display window 30 back into chamber 62. Although many fans can be used, one suitable fan is direct current (d.c.) brushless fan motor model number BG0703-B044-000 available from Minebea Co., Ltd. of Tokyo, Japan. It is understood that other air sources besides fans may be used without departing from the scope of the present invention.

Because some balls are very light, static electricity can cause the balls to stick to each other and to other components. To prevent this, a variety of static discharge devices 106 may be placed in various locations in the present invention. In one embodiment, static discharge device 106 (FIG. 2A) is a bare stranded copper wire with its strands spread out. The wire is placed in the flow of air between agitator 50 and container 16 and wire is attached to a common ground.

Prize display 14 may also comprise means for simultaneously displaying a plurality of balls 92. To accomplish this, plate 68 may have multiple holes 67 (not shown), each with its own gate 66 and actuator 64, for supplying balls to multiple display windows. Thus, holder 58 may be positioned so that the appropriate ball is positioned over the appropriate hole 67 for supplying the appropriate display window 30. Alternatively, a plurality of ball holders 58 may be provided, each one supplying balls to a separate display window 30.

Figure 6:
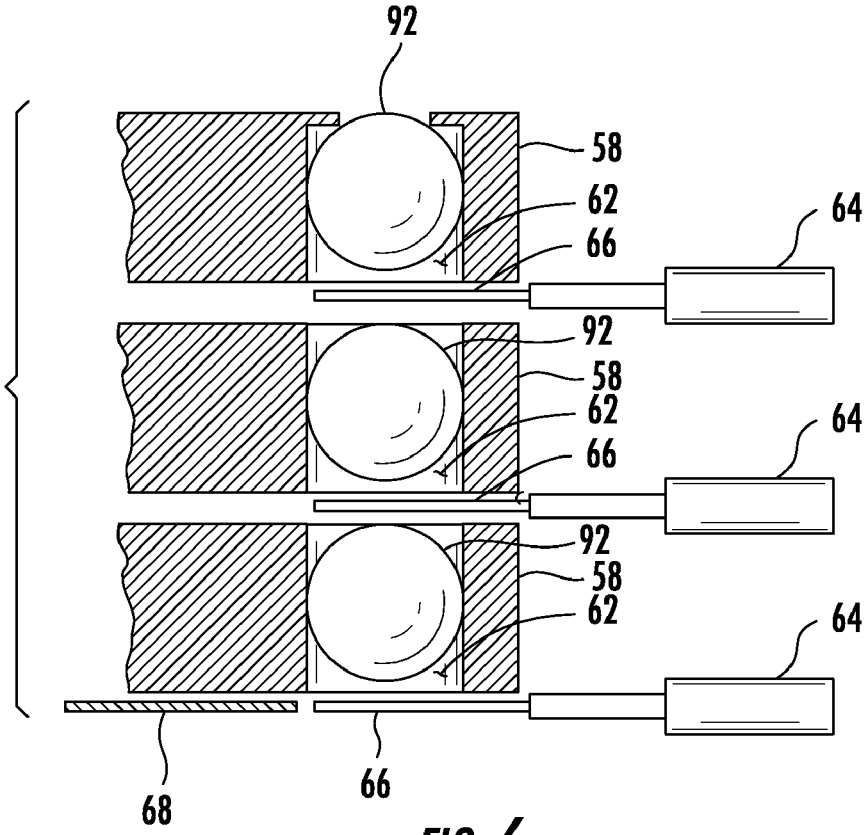
FIG. 6 is substantially a schematic diagram of an alternative embodiment using multiple stacked ball holders.

In yet another embodiment, seen in FIG. 6, a plurality of separately controlled ball holders 58 are arranged in a stack. Each ball holder 58 is rotated to a position so that chambers 62 are aligned above display window 30 (FIG. 1A). Gates 66 are then opened and balls 92 are allowed to fall into display window 30. In this embodiment, display window 30 is large enough to display three balls simultaneously. When the display period has ended, balls 92 are blown back into chambers 62 and gates 66 are closed to separate and contain the balls. The action of gates 66 separates prize balls 92 into separate chambers 62.

With multiple balls being displayed, it is possible to use combinations of balls to indicate various bonus outcomes. It is also possible to replace the primary display of a gaming device with selector and prize display device 14. In other words, game apparatus 20 may be entirely replaced with selector and prize display device 14.

Figure 7:
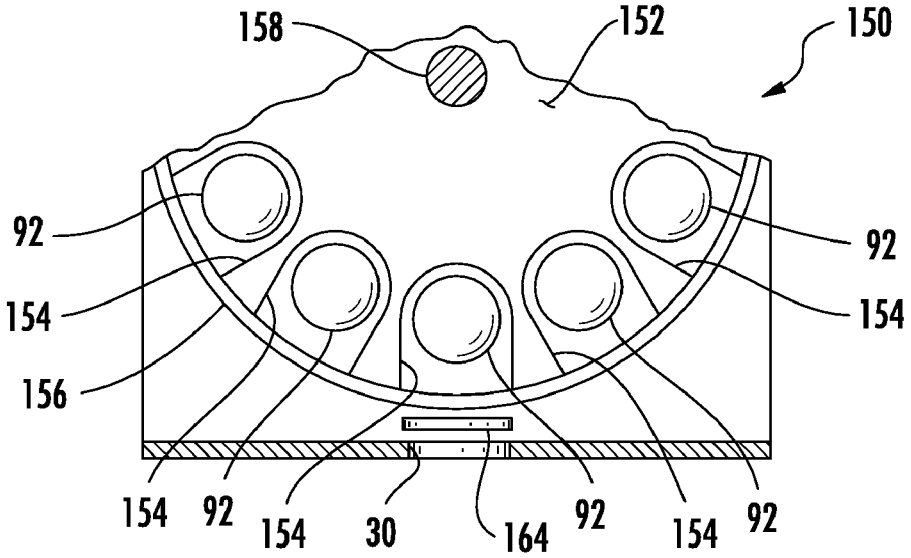
FIG. 7 is substantially an alternative display mechanism useful in the present invention.

An alternative display mechanism 150 is shown in FIG. 7. Display mechanism 150 comprises a cylindrical ball holder 152 that may be rotated around its central axis 158. Ball holder 152 comprises a plurality of chambers 154 positioned along the periphery of the holder, each chamber is configured to hold ball 92. Unlike the embodiment described in FIG. 2A, it is not necessary to remove and replace balls 92 from chambers 154. Instead, at least a portion of the outer wall of each chamber 154 comprises a transparent material that allows players to view balls 92 inside the chamber. The transparent wall may comprise a ring of transparent material 156 that surrounds holder 152. A shutter device or door 164 may be provided between display window 30 and holder 152 for blocking the view of players while the holder is rotated. Although this embodiment has the advantage of a simpler mechanism, it may be less entertaining to players because it may be more apparent to the players that balls 92 do not originate from jumbled ball display 12.

Figure 1C:
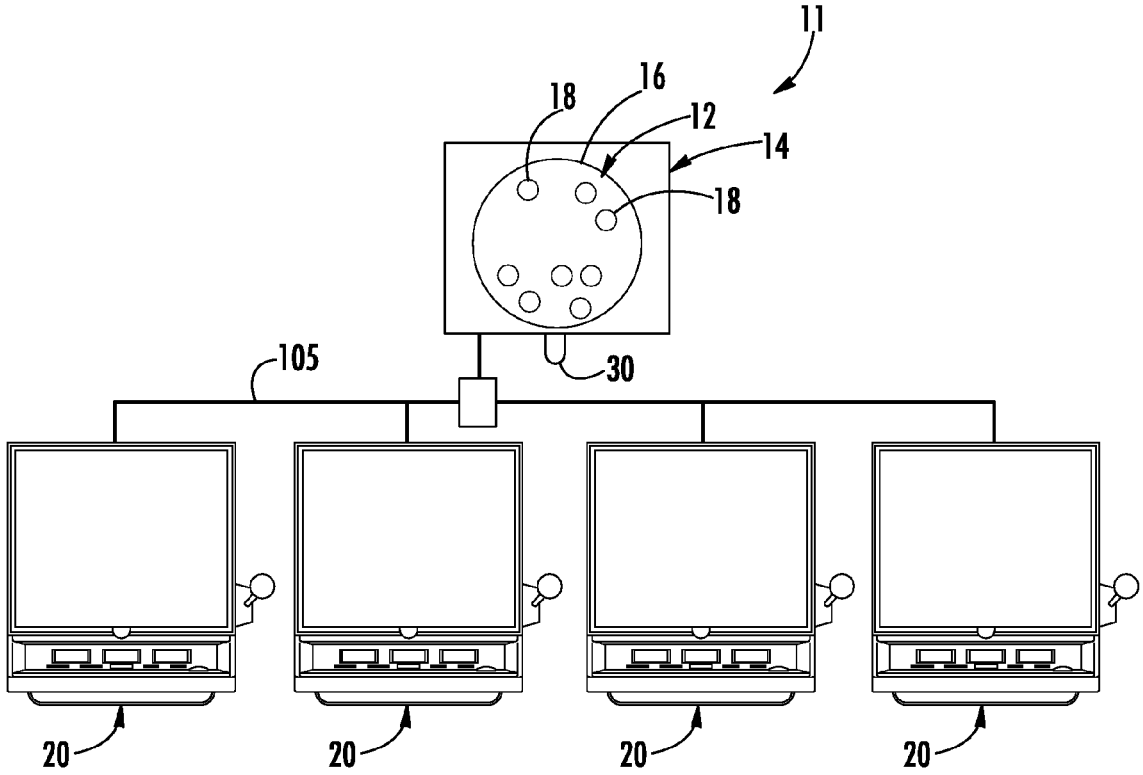
FIG. 1C is substantially atop schematic diagram of a display device useful in the present invention in use with a plurality of game apparatus.

As seen in FIG. 1C, a single display device 11 may also be used with a plurality of game apparatus 20. In this embodiment, each game apparatus is in communication with display device 11 by a communication device 105. Communication device 105 may be a network cable, such as an Ethernet cable, and appropriate hardware, such as network interface cards, may be included in display device 11 and game apparatus 20. When one of the game apparatus 20 produces a bonus-activating event, a signal is sent to display device 11. A prize ball may then be selected and displayed as described above.

Turning now to FIG. 2B, one embodiment for operation of prize display 14 begins with controller 76 detecting a bonus-activating event 170. Controller 76 may then drive display 110 (shown in FIG. 1A) to display an appropriate presentation or message 172. As discussed above, controller 76 may wait for player input from input device 90 (shown in FIG. 2A) or it may wait for a predetermined period of time 174. At some point, controller 76 activates the agitator 176 and selects a prize ball to be displayed 178 from ball holder 58. Controller 76 then drives positioning mechanism 77 to position ball holder 58 so that the selected prize ball may be displayed 180 and causes display mechanism 29 to display the selected ball 182. Controller 76 may then wait a predetermined period of time so that the player may see the displayed prize ball 184, after which it causes display mechanism 29 to stop displaying the selected prize ball 186. The agitator is then deactivated 188 and controller 76 returns to a monitoring state to detect the next bonus activating event 170.

Transport Devices

Figure 8:
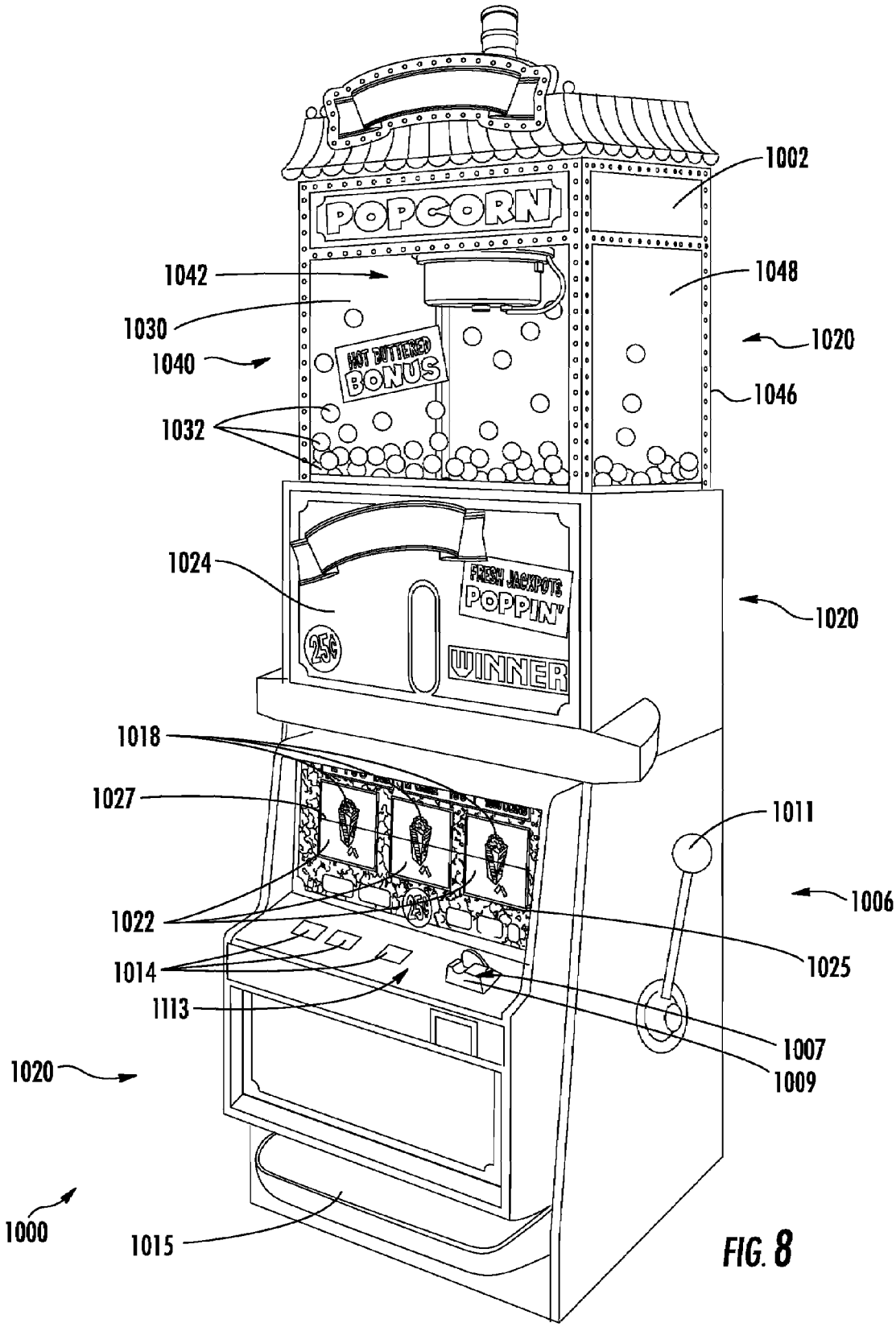
FIG. 8 is a front perspective view of another embodiment of a gaming device useful in the present invention.

FIG. 8 shows another embodiment involving a gaming device 1000 having a jumbled ball display 1002 provided with a transport device 1004 useful in the present invention (see FIGS. 9-15D). Notably, gaming devices 1000 may be any of a large number of devices that are configured to allow players (not shown) to play a game, such as those typically found in arcade and casino environments, including arcade games, video games, gambling machines, video poker machines, and slot machines, for example. In this embodiment, the gaming device 1000 represents a slot machine 1006, which may have a value acceptor 1007 for accepting value from a player, such as a coin slot 1009, card reader (not shown), or a voucher reader (not shown). A handle 1011 and/or a button(s) 1014 also may be provided for activating the gaming device 1000 to begin a game.

A payout mechanism (not shown) and a coin dispenser 1015 maybe provided for awarding prizes or for dispensing value to players cashing out and retiring from a game. A printer (not shown) may also be provided for printing out cashless vouchers. A pay table (not shown) may further be provided to allow a player to see what symbol 1018 or combination of symbols provide one or more winning events.

As further shown in FIG. 8, the gaming device 1000 includes one or more display devices 1020 which may include physical game reels 1022, a bonus display 1024, and/or a video display device (not shown) including a cathode ray tube, LCD (liquid crystal display), LED, plasma, for example, configured to display at least one symbol 1018 from a plurality of symbols 1018, which may include, for example, any letter, word, number, picture or image. In this figure, the symbols 1018 generally are represented by "a popcorn box with popcorn." The physical game reels 1022 may be attached to a drive mechanism (not shown) to rotate the reels 1022 in a manner well known in the art.

A panel 1025 may cover the game reels 1022 such that only a portion of their individual circumferences is shown to the player. At least one symbol 1018 from any of the game reels 1022 may be used to display a game outcome and/or activate a base game or bonus game cycle 1026 (see FIG. 16). At least one pay line 1027 may be provided for the player to use in determining a game outcome based on the symbol 1018 or combination of symbols 1018 positioned thereon.

As indicated above, the display device 1020 also may include a video display (not shown) displaying game symbols 1018, for example, letters, words, numbers, pictures or images, in any number of formats and arrangements. Alternatively, the video display (not shown) may display images of game reels 1022 having symbols 1018 and an image of at least one pay line 1027. It is understood that the gaming device 1000 may comprise more than one display device 1020 such that the gaming device 1000 could include physical game reels 1022, a bonus display 1024, a jumbled ball display 1002, and/or a video display (not shown), or any combination thereof Accordingly, the display device 1020, such as the jumbled ball display 1002, may be positioned at the top of the gaming device 1000, separate from the gaming device 1000 but in communication therewith, or in communication with a plurality of different gaming devices 1000 via a computer network in a manner that is well known in the art.

FIG. 8 shows the jumbled ball display 1002 and bonus display 1024, which typically are configured to cooperate with the gaming device 1000 during abase game or bonus game. One acceptable type of jumbled ball display 1002 is described in U.S. Pat. No. 6,338,678, issued on Jan. 15, 2002, incorporated herein by reference. Notably, the jumbled ball display 1002 in FIG. 8 includes a container 1030 that is configured to hold at least one, typically a plurality, of movable objects 1032 including any type of ball, for example, keno balls, ping-pong balls and rubber balls.

A ball holder (not shown in FIG. 8, but similar to that discussed regarding FIGS. 2A, 3 and 4, for example) may be used in conjunction with the jumbled ball display 1002 and is further described in U.S. Pat. No. 6,338,678. More specifically, the ball holder (not shown) maybe contained within the bonus display 1024 to display one or more movable objects 1032, including any type of ball, for example, keno balls, ping-pong balls or rubber balls, associated with a base game or bonus game cycle.

The container 1030 may be at least partially transparent allowing players to view one or more of the movable objects 1032 inside of the container. The container 1030 may be made of acrylic or other materials, including, for example, plastic, glass, or wire mesh. One or more movable objects 1032 may have colors and/or symbols, for example, letters, words, numbers, pictures or images.

Figure 9:
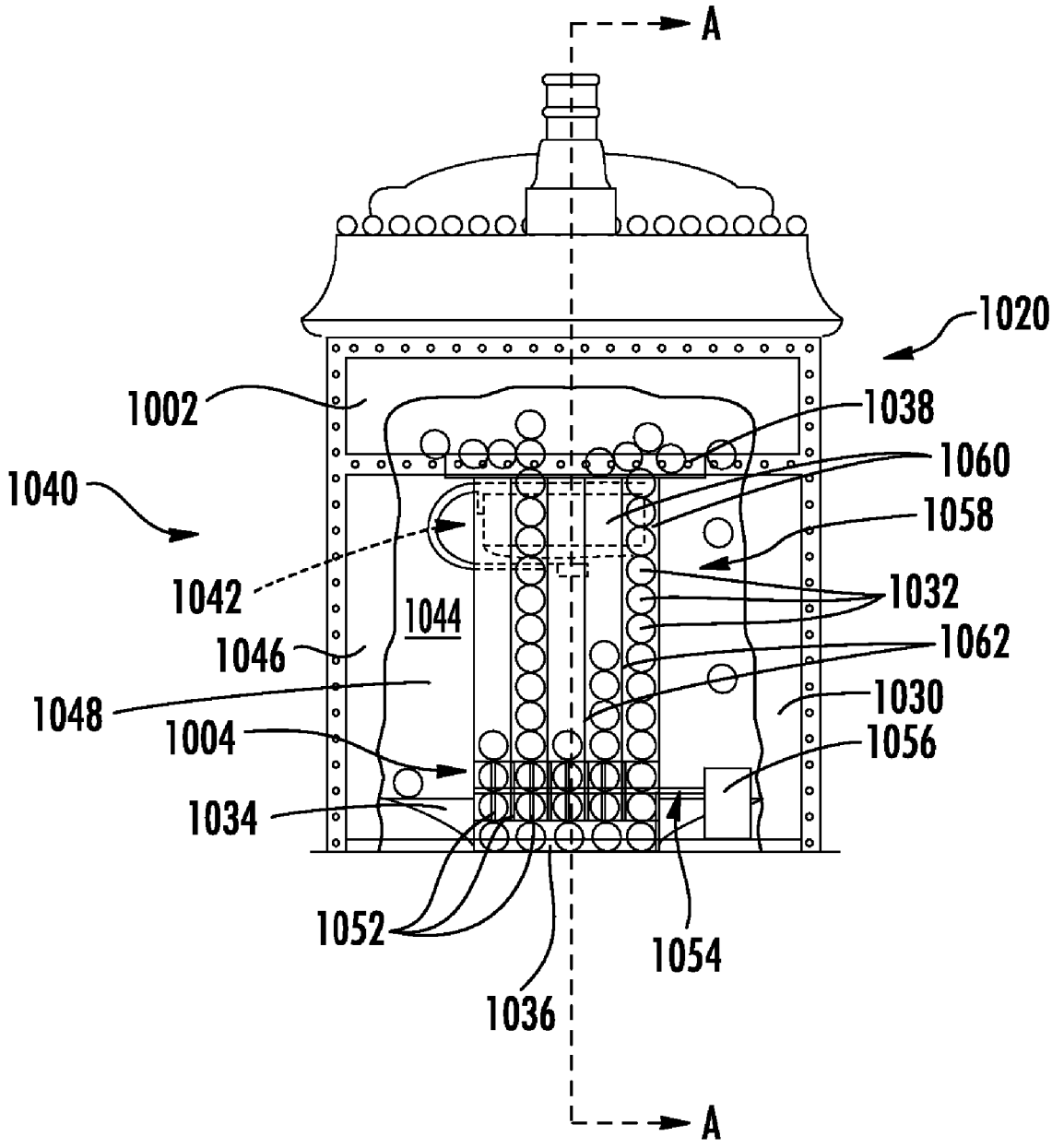
FIG. 9 is a partially cut-away rear elevational view of the jumbled ball display of FIG. 8 showing a transport device.
Figure 10:
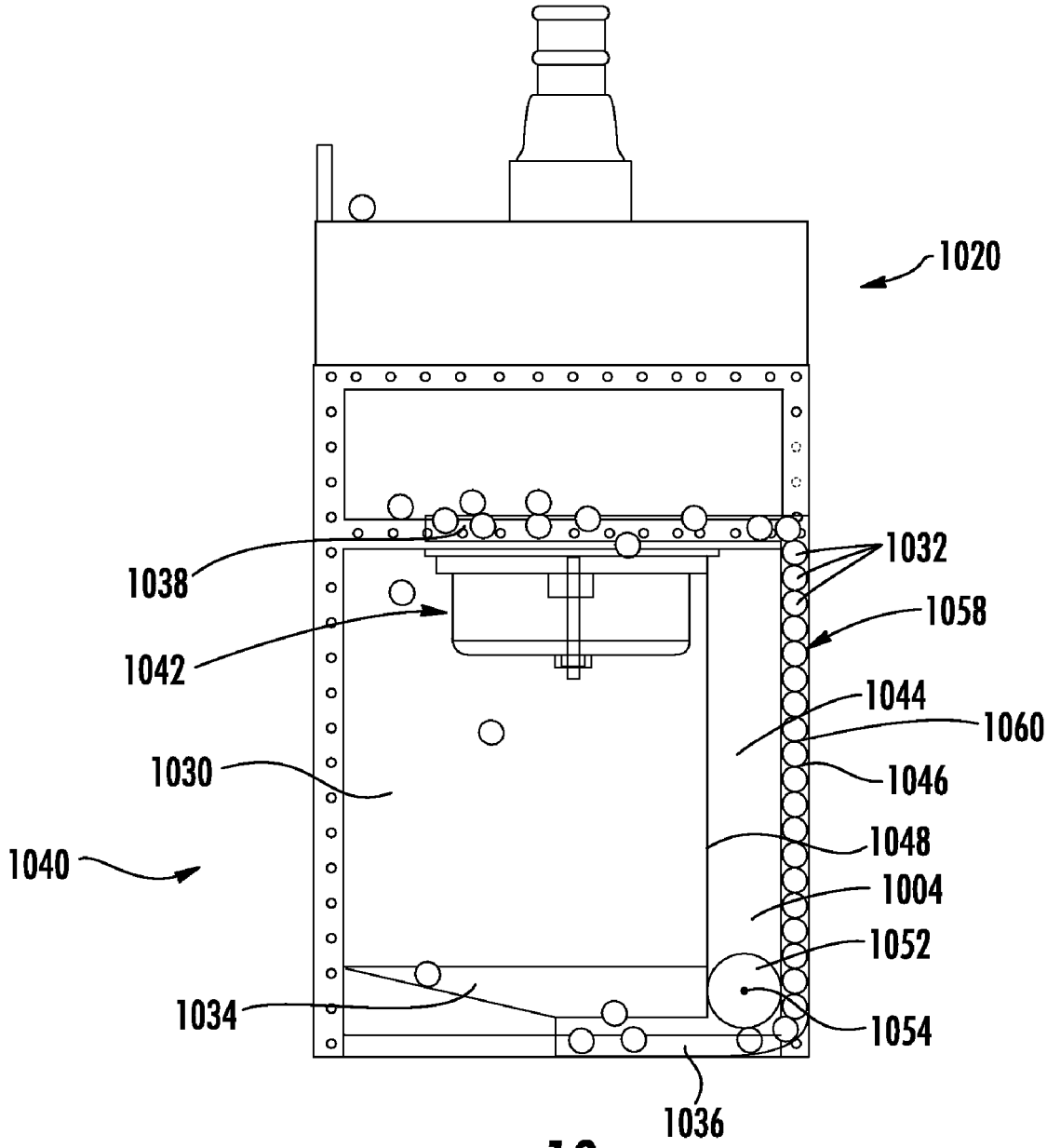
FIG. 10 is a cross-sectional view of FIG. 9 taken along line A-A.

As best shown in FIGS. 9 and 10, the container 1030 further includes a floor 1034 having a receptacle 1036 configured to collect the movable objects 1032. The floor 1034 typically is sloped downwardly toward the receptacle 1036 so that the movable objects 1032 move effortlessly there toward. A platform 1038 typically is located suspended substantially within the top half of the container 1030 for receiving one or more movable objects 1032 from the at least one transport device 1004. In FIGS. 8-14, the container is shown simulating a popcorn popper 1040, such as an old fashioned kettle corn popper. The platform 1038 typically is disguised by a kettle 1042.

The container 1030 further includes a rear compartment 1044 substantially defined by a back wall 1046 and a spaced-apart false wall 1048. The compartment 1044 allows for the placement of transport device 1004 therein with the false wall 1048, typically keeping the transport device 1004 out of view from a player. Suitable transport devices 1004 may include, for example, conveyor belts, discs, wheels, lifts, claws and augers. The transport device 1004 may further include at least one transport component 1050 (see FIGS. 13-15C) such as, for example, cups, bowls, scoops, buckets, ledges, shovels and blades, cooperating with the transport device 1004 and configured to receive the at least one movable object 1032, for example, a ball, from the receptacle 1036. In one embodiment, the transport component is a helical blade.

As further shown in FIGS. 9 and 10, the transport device 1004 includes a plurality of vertically oriented discs 1052 rotatably secured to an axle 1054 that cooperates with a motor 1056. The discs 1052 may comprise, for example, plastic or rubber. When the motor 1056 is activated, the discs 1052 rotate about the axis of the axle 1054. The discs 1052 typically are located substantially within the receptacle 1036 such that the discs 1052 are spaced apart therefrom so that a movable object 1032 can be received therebetween. Accordingly, one or more movable objects 1032 in the receptacle 1036 come into contact with the rotating discs 1052, and are moved up to the platform 1038 by way of a chute 1058, which may include one or more channels 1060 separated by dividers 1062. The channels 1060 typically are slightly wider than the movable objects 1032 and help guide the objects 1032 to the platform 1038. Notably, the rotating discs 1052 continuously fill the channels 1060 with the movable objects 1032 thereby forcing the movable objects 1032 up to the platform 1038. The movable objects 1032 eventually are received onto the platform 1038 only to free fall therefrom back to the floor 1034 thereby typically providing the illusion of popcorn popping and falling from the kettle 1042.

In an alternative embodiment, as shown in FIGS. 15E and 15F, a cylinder 1064 may replace the circular discs 1052. The cylinder 1064 similarly is disposed about an axle 1066 for movement thereabout and may include, for example, plastic or rubber. The cylinder 1064 can be activated by a motor 1056 and typically includes an accordion-like surface 1068 for cooperating with the at least one movable objects 1032. In another alternative embodiment (not shown), a cylinder may comprise ridges in the form of a continuous ribbed surface, where the ribs or ridges are aligned circumferentially along the surface of the cylinder, that is, orthogonal to the axle of the cylinder; as the cylinder rotates about the axle, movable objects caught in the ridges or ribs are thereby transported on the surface of the cylinder along the axis of the cylinder. This embodiment is in contrast to cylinder 1064 (FIG. 15F) where the strips of the accordion surface are arranged parallel to the axle, rather than being arranged at right angles to the axle.

Figure 11:
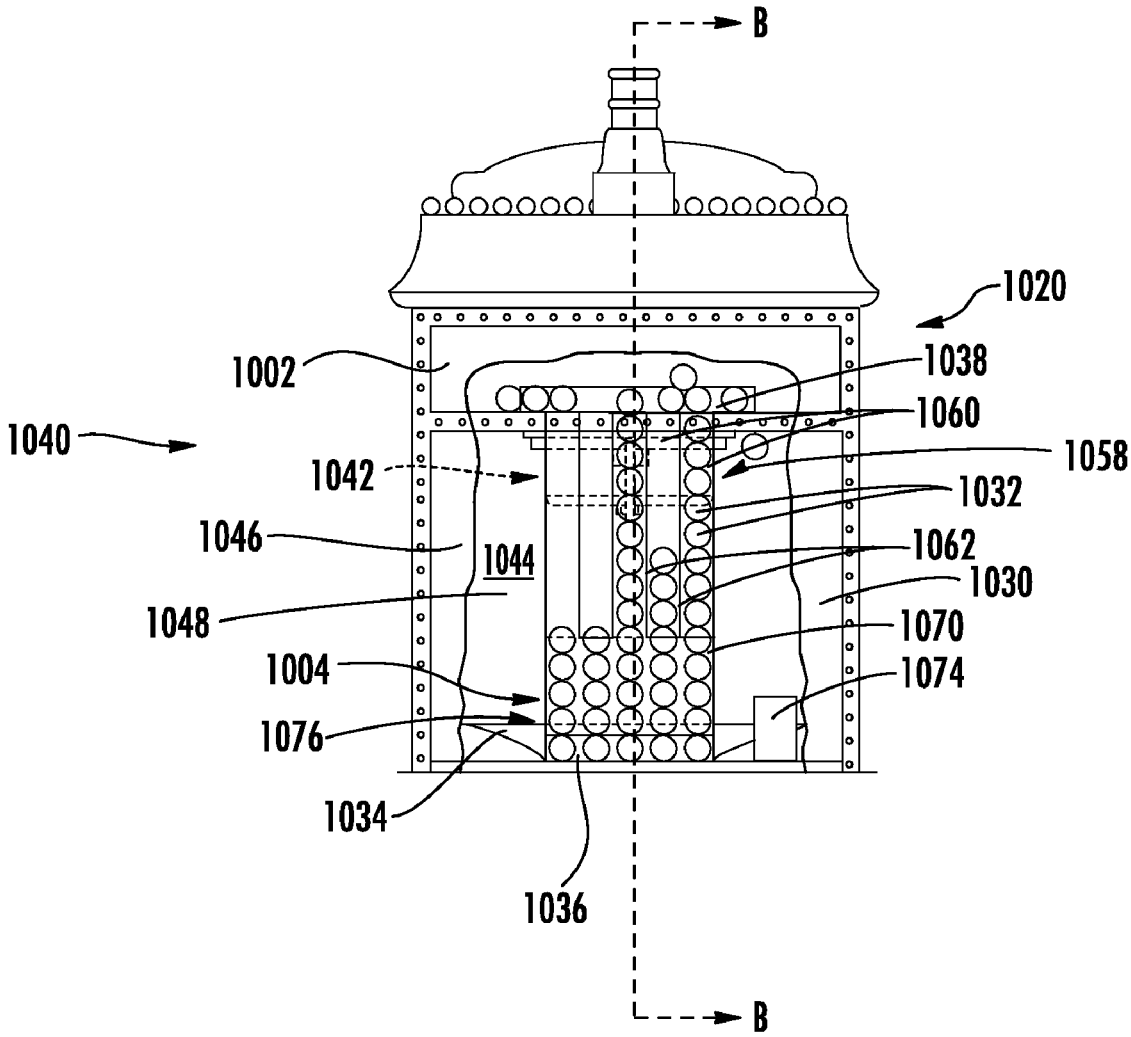
FIG. 11 is a partially cut-away rear elevational view of the jumbled ball display of FIG. 8 showing another embodiment of a transport device.
Figure 12:
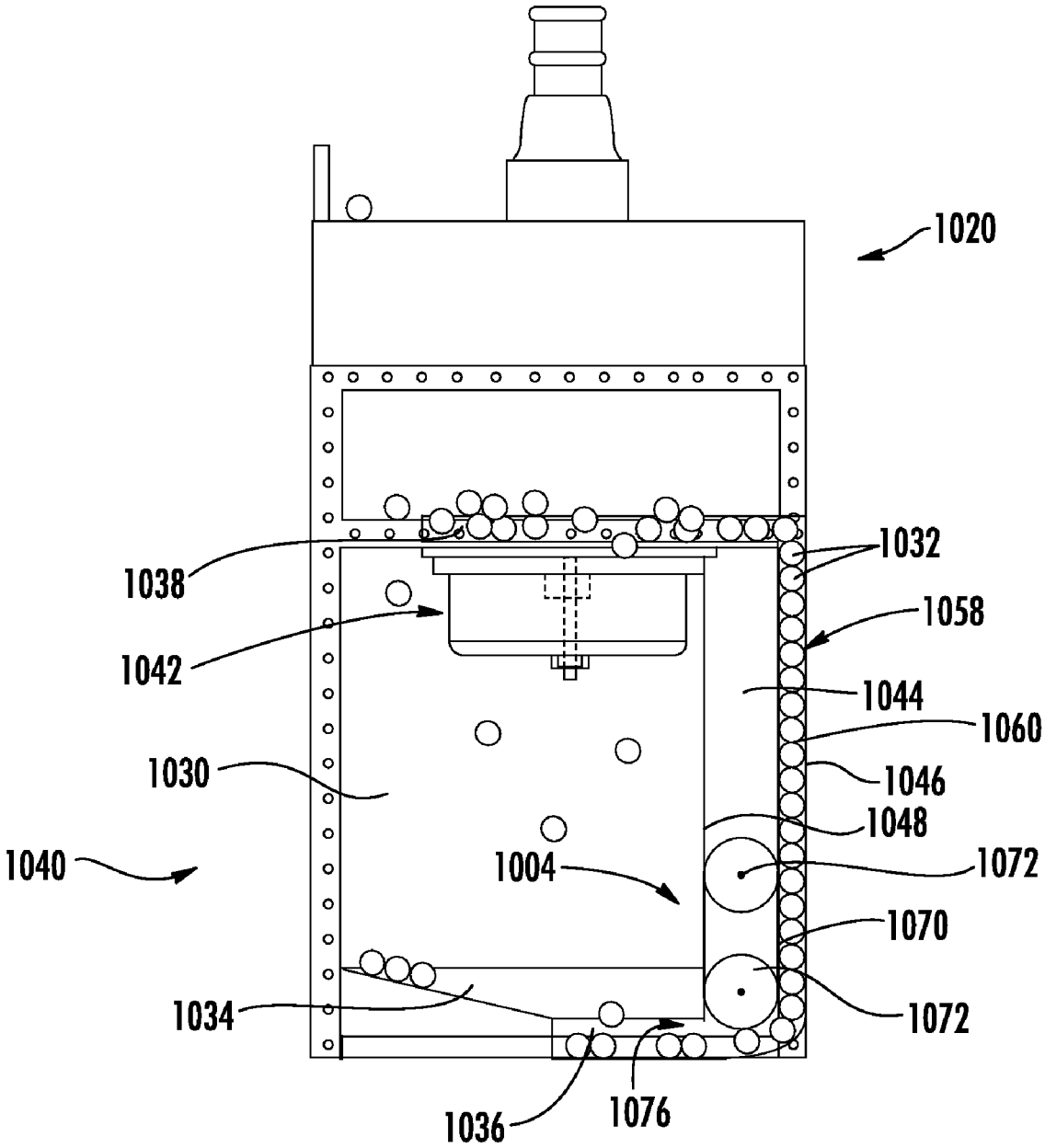
FIG. 12 is a cross-sectional view of FIG. 11 taken along line B-B.

FIGS. 11 and 12 show another embodiment of the transport device 1004 useful in the present invention including at least one conveyor belt 1070 substantially vertically oriented and cooperating with at least one roller 1072 to rotate therearound when at least one roller 1072 is activated by a motor 1074. The conveyor belt 1070 can be any conventional type known in the art and may include, for example, wire mesh, rubber or plastic. It is understood that a plurality of conveyor belts 1070 may be placed in a side-by-side arrangement in place of one conveyor belt 1070.

When the motor 1074 is activated, conveyor 1070 belt rotates a round the rollers 1072. Typically, at least one end 1076 of the conveyor belt 1070 is substantially located within the receptacle 1036 with the one end 1076 being spaced apart therefrom so that the movable objects 1032 can be received therebetween, typically wedged therebetween.

Accordingly, one or more movable objects 1032 in the receptacle 1036 come into contact with the conveyor belt 1070, and are moved from the receptacle 1036, typically via friction, up to the platform 1038 by way of the chute 1058, which includes the one or more channels 1060 separated by dividers 1062. The channels 1060 typically are slightly wider than the movable objects 1032 and help guide the objects 1032 to the platform 1038. Notably, the conveyor belt 1070 continuously fills the channels 1060 with the movable objects 1032 thereby forcing the movable objects 1032 up to the platform 1038. The movable objects 1032 eventually are received onto the platform 1038 only to free fall therefrom back to the floor 1034 thereby providing the illusion of popcorn popping and falling from the kettle 1042. It is understood that the conveyor belt 1070 could extend substantially the length of the container 1030 to transport the movable objects 1032 directly to the platform 1038.

Figure 13:
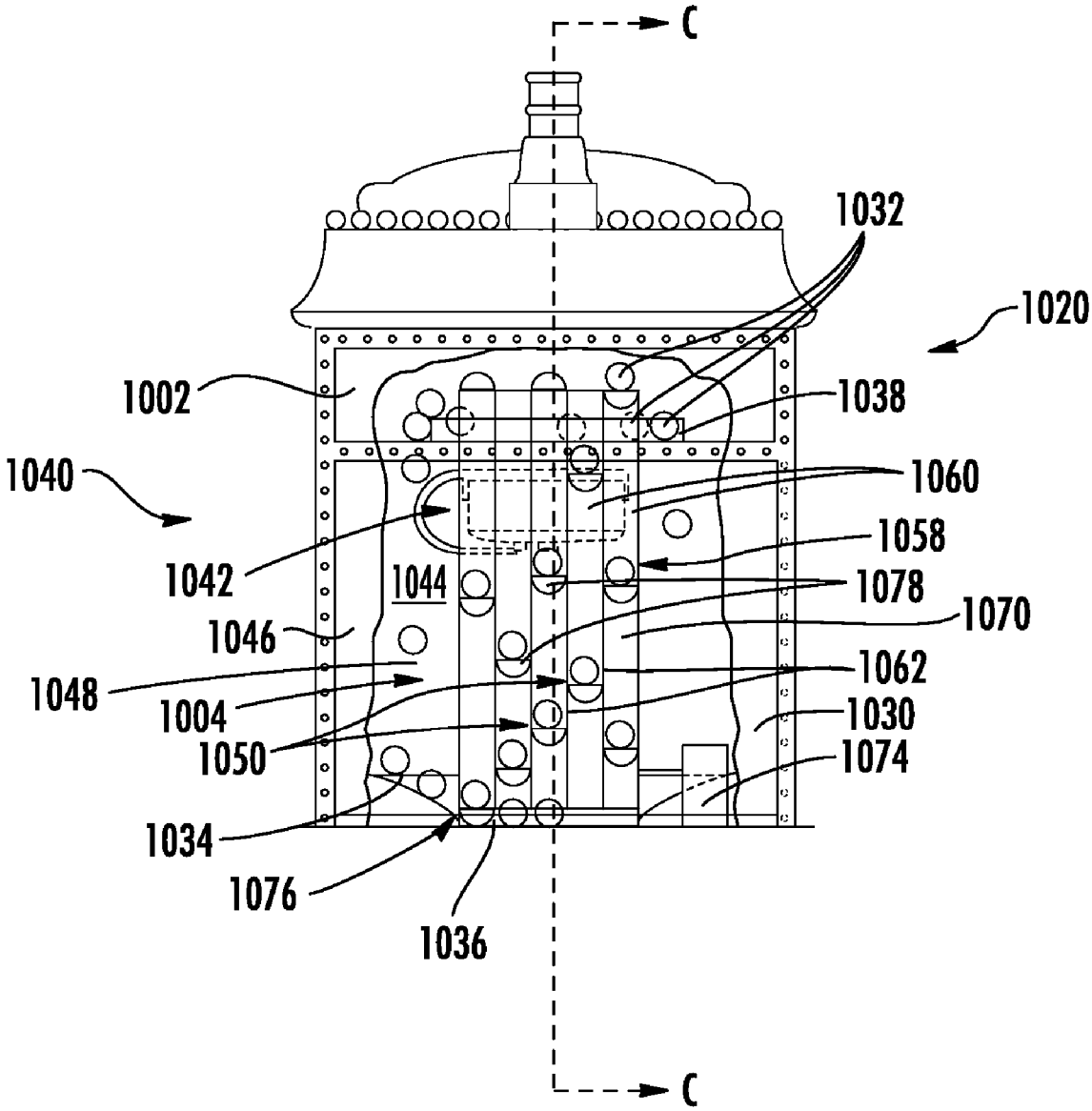
FIG. 13 is a partially cut-away rear elevational view of the jumbled ball display of FIG. 8 showing yet another embodiment of a transport device.
Figure 14:
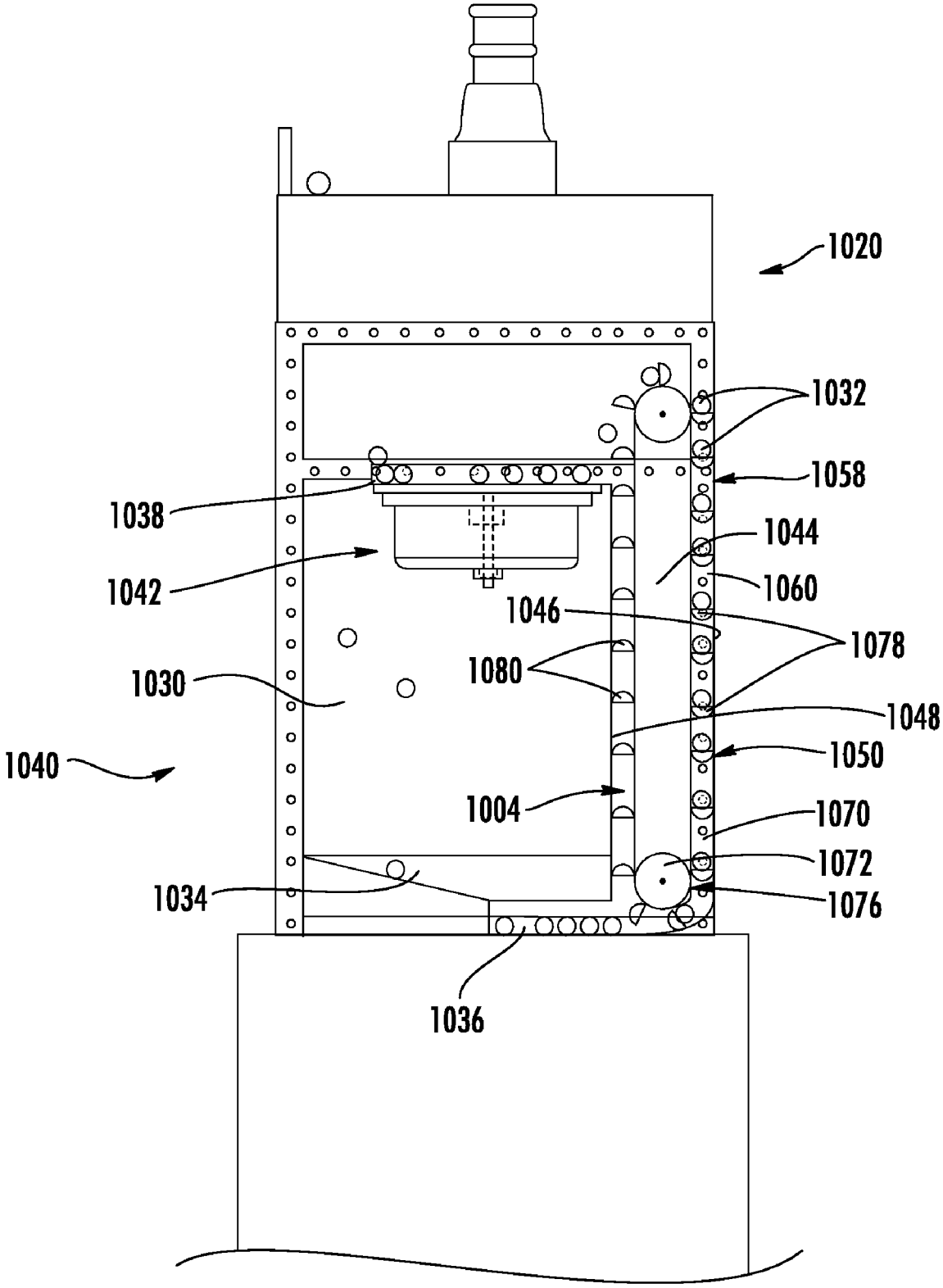
FIG. 14 is a cross-sectional view of FIG. 13 taken along line C-C.

FIGS. 13 and 14 show yet another embodiment of the transport device 1004 useful in the present invention typically extending substantially the length of the container 1030 and being provided with at least one transport component 1050, such as for example, cups, bowls, scoops, buckets, ledges, shovels or blades. Notably, the conveyor belt 1070 cooperates with rollers 1072 to rotate therearound when at least one of the rollers 1072 is activated by the motor 1074.

As further shown in FIGS. 13 and 14, the transport component 1050 cooperates with the transport device 1004 and is configured to receive the at least one movable object 1032, for example, a ball, from the receptacle 1036. Here, transport component 1050 includes a plurality of cups 1078. If channels 1060 are present within the chute 1058, each cup 1078 is aligned with a designated channel 1060. Alternatively, it is understood that channels 1060 may be omitted with this type of transport device 1004.

Accordingly, each cup 1078 receives a movable object 1032 from the receptacle 1036 and transports the object 1032 to the platform 1038. The movable object 1032 eventually is received by the platform 1038 and an empty cup 1080 (FIG. 14) is allowed to return to the receptacle 1036 to retrieve another movable object 1032. It is understood that a plurality of conveyor belts 1070 having transport components 1050 may be placed in a side-by-side arrangement to transport movable objects 1032 to the platform 1038.

Figure 15A:
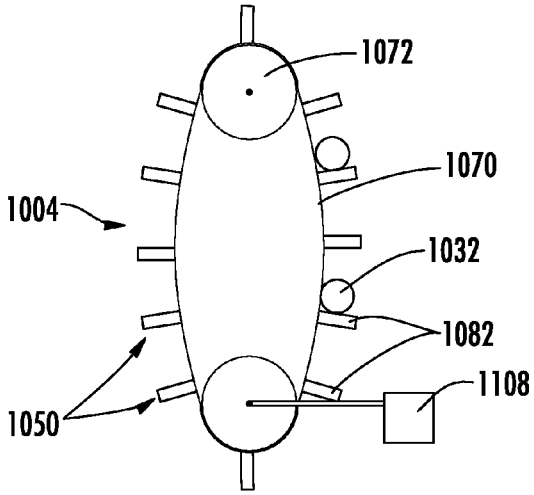
FIG. 15A is a cross-sectional view of another embodiment of a transport device useful in the present invention.
Figure 15B:
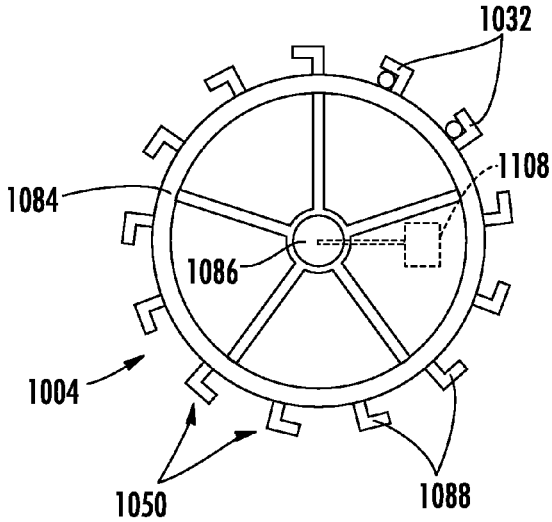
FIG. 15B is a cross-sectional view of another embodiment of a transport device useful in the present invention.
Figure 15C:
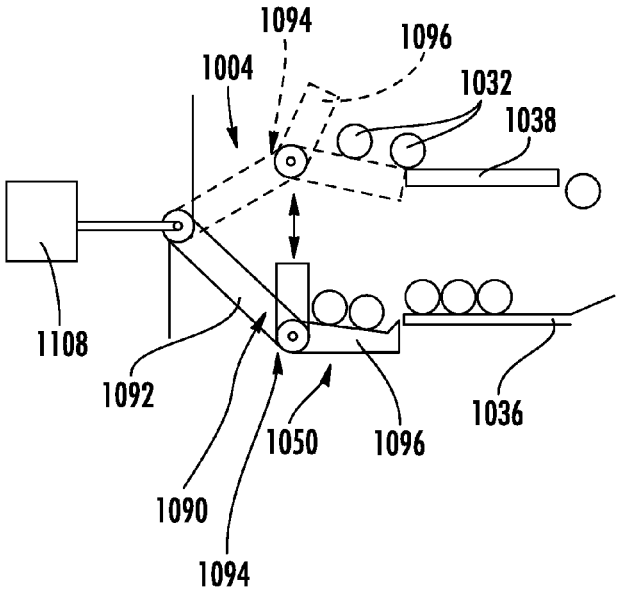
FIG. 15C is a cross-sectional view of another embodiment of a transport device useful in the present invention.
Figure 15D:
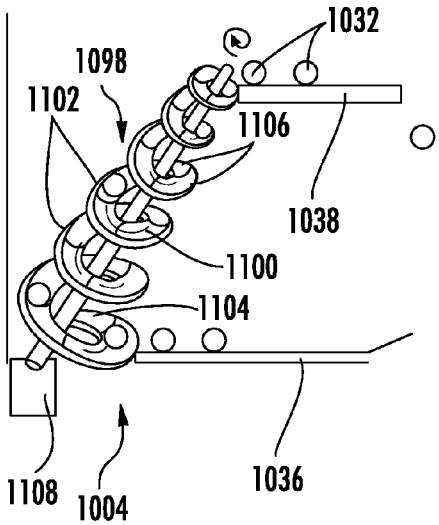
FIG. 15D is a perspective view of another embodiment of a transport device useful in the present invention.

FIGS. 15A-15D depict yet other embodiments of the transport device 1004 useful in the present invention. FIG. 15A shows the transport device 1004 including the conveyor belt 1070 cooperating with rollers 1072 and having ledges 1082 as the transport component 1050. FIG. 15B shows the transport device 1004 including a wheel 1084 disposed about a central axle 1086 and having buckets 1088 as the transport component 1050. FIG. 15C shows the transport device 1004 including a lift 1090 having a movable arm 1092. One end 1094 of the arm 1092 cooperates with the transport component 1050, a shovel 1096. FIG. 15D shows the transport device 1004 including an auger 1098 having a continuous blade 1100 as the transport component 1050. The continuous blade 1100 typically has ledges 1102 extending from a top surface 1104 of the blade 1100 to provide compartments 1106 to contain the movable objects 1032 thereon. Accordingly, each transport device 1004 may be activated by a motor 1108 to transport the at least one movable object 1032 from the receptacle 1036 to the platform 1038. It is further understood that the transport device 1004 may be substantially vertically oriented or non-vertically oriented.

Figure 16:
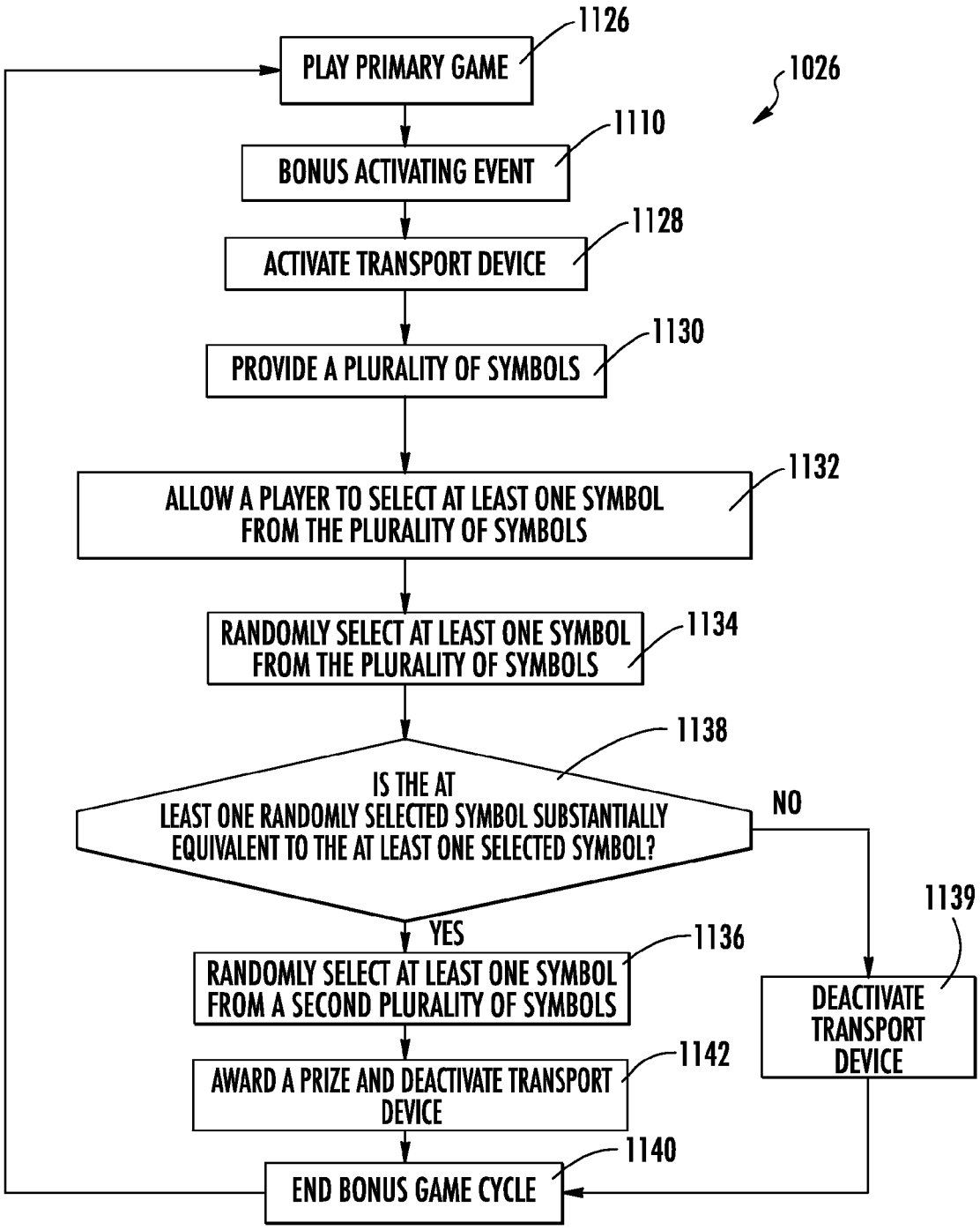
FIG. 16 is a flowchart of one embodiment of a gaming method useful in the present invention.

Returning to FIG. 8, the present gaming device 1000 may provide a base game or bonus game cycle (for example, see FIG. 16) associated with the selection of the one or more symbols 1018 from the plurality of symbols 1018 displayed by the display device 1020. The bonus game cycle (FIG. 16) typically extends the length of play of a single game play and can be triggered by any number of bonus activating events 1110 (FIG. 16). This event may be many different types of events. For example, a bonus activating event 1110 (FIG. 16) simply may include the placing of a wager (not shown) by the player or the displaying of a particular symbol 1018 such as, for example, a number, letter, picture or a combination thereof, on one or more reels. The activating event 1110 also may be based on an external event. The bonus activating event 1110 triggers the gaming device 1000 to allow a player to participate in the bonus game. The bonus activating event 1110 may include any one of the above mentioned activating events and further may include when a player accumulates a number of symbols 1018 or game outcomes over a number of separate game plays.

Method of Use

FIG. 16 illustrates one method of playing a gaming device wherein the bonus game cycle 1026 is triggered by any number of bonus activating events in step 1110 during play of the primary game in step 1126. One such bonus activating event in step 1110 includes the displaying of a particular symbol(s) 1018, such as, for example, letters, words, numbers, pictures, images or combinations thereof, on one or more reels 1022 of slot machine 1006 (see FIG. 8). For example, bonus game cycle 1026 may be activated when the "popcorn container with popcorn" symbol 1018 (see FIG. 8) appears on the third reel 1022 and on payline 1027 with the maximum wager being played. If the display device 1020 is a video display device (not shown), the symbols 1018 further may be displayed by animation.

After the occurrence of bonus activating event step 1110, as shown in FIG. 16, the transport device 1004 (FIGS. 9-15D) typically is activated in step 1128 allowing the movable objects 1032 to be transported from the receptacle 1036 and to free fall from the platform 1038 (FIGS. 9-14). Next, in step 1130, the display device 1020 or bonus display 1024, typically a video display (not shown), provides a plurality of symbols 1018. Again, the symbols 1018 may include, for example, letters, words, numbers, pictures or images. In one embodiment, three different size popcorn symbols, for example, small, medium and large, may be displayed.

As further shown in FIG. 16, the next step 1132 provides for an alternate game play wherein a player may optionally be allowed to select one or more symbols 1018 from the plurality of symbols 1018 using an input device, for example, a touch screen (not shown) or button(s) 1014 from selection panel 1113 (FIG. 8). It is understood that a controller (not shown) may select the player symbol(s) 1018 if a designated amount of time elapses. It is also understood that the controller may randomly select a symbol 1018, in step 1134, if the optional player selection is not provided.

As further shown in FIG. 16, selection of at least one symbol 1018 from the plurality of symbols 1018 occurs with the assistance of a random number generator (not shown). The randomly selected symbol 1018, for example, different sized popcorn containers with popcorn, typically is associated with a number of symbols 1018 that the controller may randomly select from in step 1134. It is to be noted that the symbol(s) 1018 from which the controller randomly selects may not be identical, but rather substantially equivalent, to the symbol(s) 1018 provided in step 1130. More specifically, the symbol(s) 1018 provided in step 1130 may include, for example, a picture or image, while the symbol(s) 1018 randomly selected by the controller may include, for example, a letter or word, or vice-versa. By way of specific example, an image of a large-sized popcorn box may be provided in step 1130 while the controller may randomly select the word "Large Popcorn" such that the symbols 1018 are substantially equivalent, yet not exactly the same.

Once the controller has randomly selected one or more symbols 1018 from the plurality of symbols 1018 in step 1134, the symbol 1018 is displayed to the player via one or more of the display devices 1020. In optional step 1138, the controller will determine if the randomly selected symbol 1018 is substantially equivalent to the at least one selected symbol 1018 from step 1132. If they are not substantially equivalent, the deactivation of the transport device 1004 (FIGS. 9-15D) occurs at step 1139 and the bonus game cycle 1026 ends at step 1140.

If the symbols 1018 are substantially equivalent in optional step 1138, or directly after step 1134 if optional step 1138 is not available, the controller selects at least one symbol 1018 from a second plurality of symbols 1018 in step 1136. The symbol 1018 from the second plurality of symbols 1018 can include, for example, letters, words, numbers, pictures or images. In one embodiment, the symbol 1018 from a second plurality of symbols 1018 includes a prize symbol such as a prize ball (not shown) selected from the ball holder (not shown) wherein the prize balls represent different bonus award amounts and, optionally, multipliers, for example, 10, 15, 20, 25, 30, 35, 50, 75, 100, 250 and a 2× ball.

The controller then displays at least one symbol 1018 from the second plurality of symbols 1018 to the player, such as via the bonus display 1024 (see FIG. 8). As indicated above, an award is associated with symbol 1018 selected from the second plurality of symbols 1018 such that the controller awards a prize to the player and deactivates the transport device in step 1142. By way of specific example, when a 2× ball (not shown) is displayed from the ball holder (not shown), the player is awarded 2× the accumulated bonus. If the player was entitled to only one randomly selected symbol, for example, a prize ball, from the second plurality of symbols, the player will receive 2× the top award (2×250)=500. If the player was entitled to two bonus balls, the second ball value is multiplied by 2×. If the second ball is also a 2× ball, the player will receive 4× (2××2×) the top award (4×250)=1000. If the player was entitled to three bonus balls, and all three are a 2× ball, the player will receive 8× (2××2××2×=8) the top award ball (8×250)=2000.

After step 1142, the bonus game cycle 1026 ends with step 1140 such that play of the primary game then may return to step 1126. Accordingly, all awards may be multiplied by the total wager.

If any actual prize is money, the amount of the prize maybe added to the player's credit meter (not shown) or the prize may be dispensed from, for example, the coin dispenser 1015 (FIG. 8). Different kinds of prizes, besides monetary prizes, may be awarded. For example, the prizes may be goods, services or additional games. The goods and services may be awarded in the form of for example, physical objects, tickets, vouchers and coupons. Additional games may be presented in the form of tickets, such as scratch-off lottery tickets. In the embodiments in which tickets, vouchers or coupons are used, the objects are dispensed using an internally or externally mounted dispenser. Such dispensers are well known in the art.

Figure 17A:
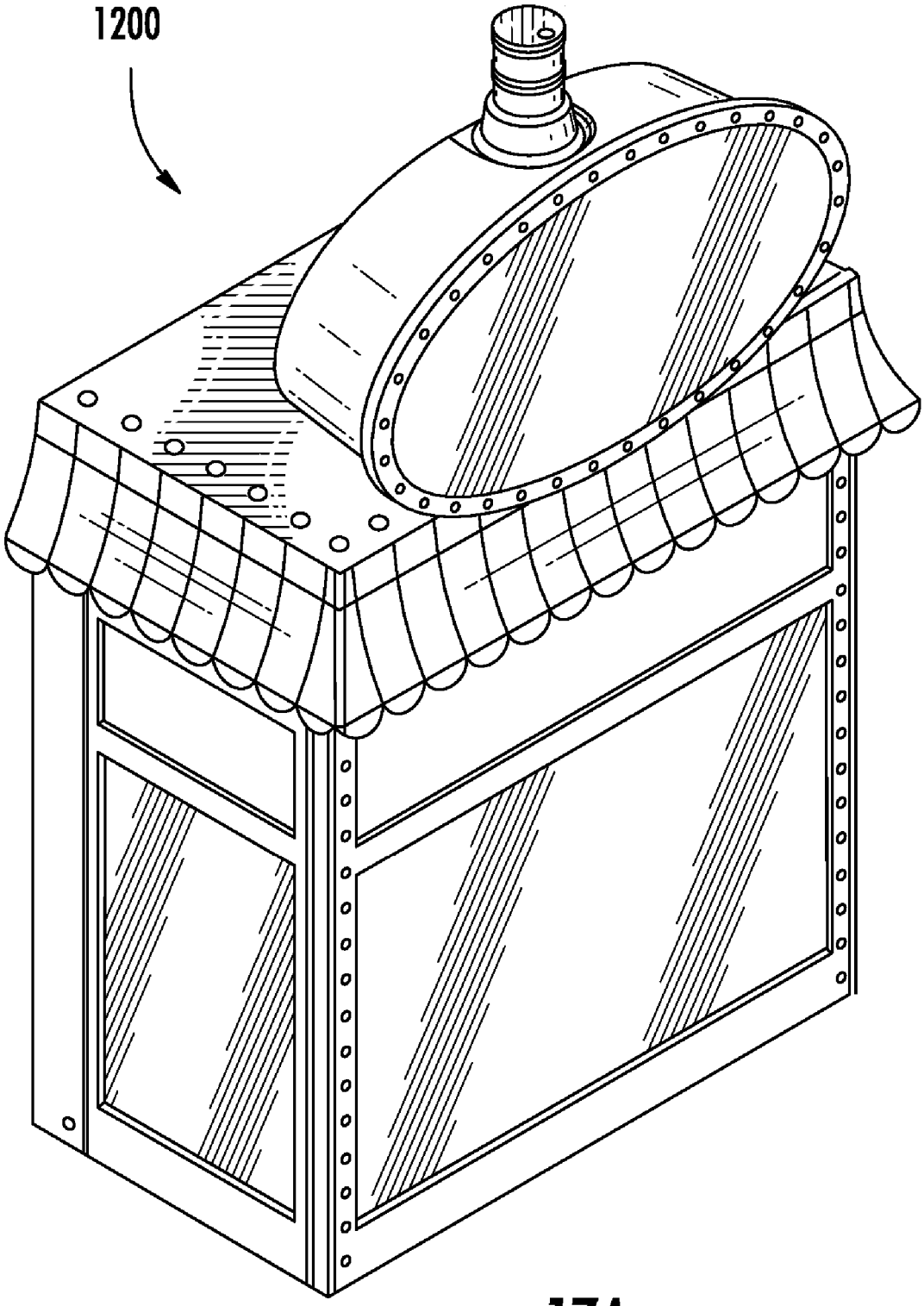
FIG. 17A is substantially a front perspective view of a display housing of a gaming device of the present invention.

As shown in FIG. 17A, one embodiment of the display portion of a gaming device of the present invention may include a display housing 1200 which encloses some of the elements of the gaming device. In this embodiment, housing 1200 may be attached to game apparatus 20 and could replace the jumbled ball display 12 portion of display device 11 in gaming device 10 of FIG. 1A.

Figure 18:
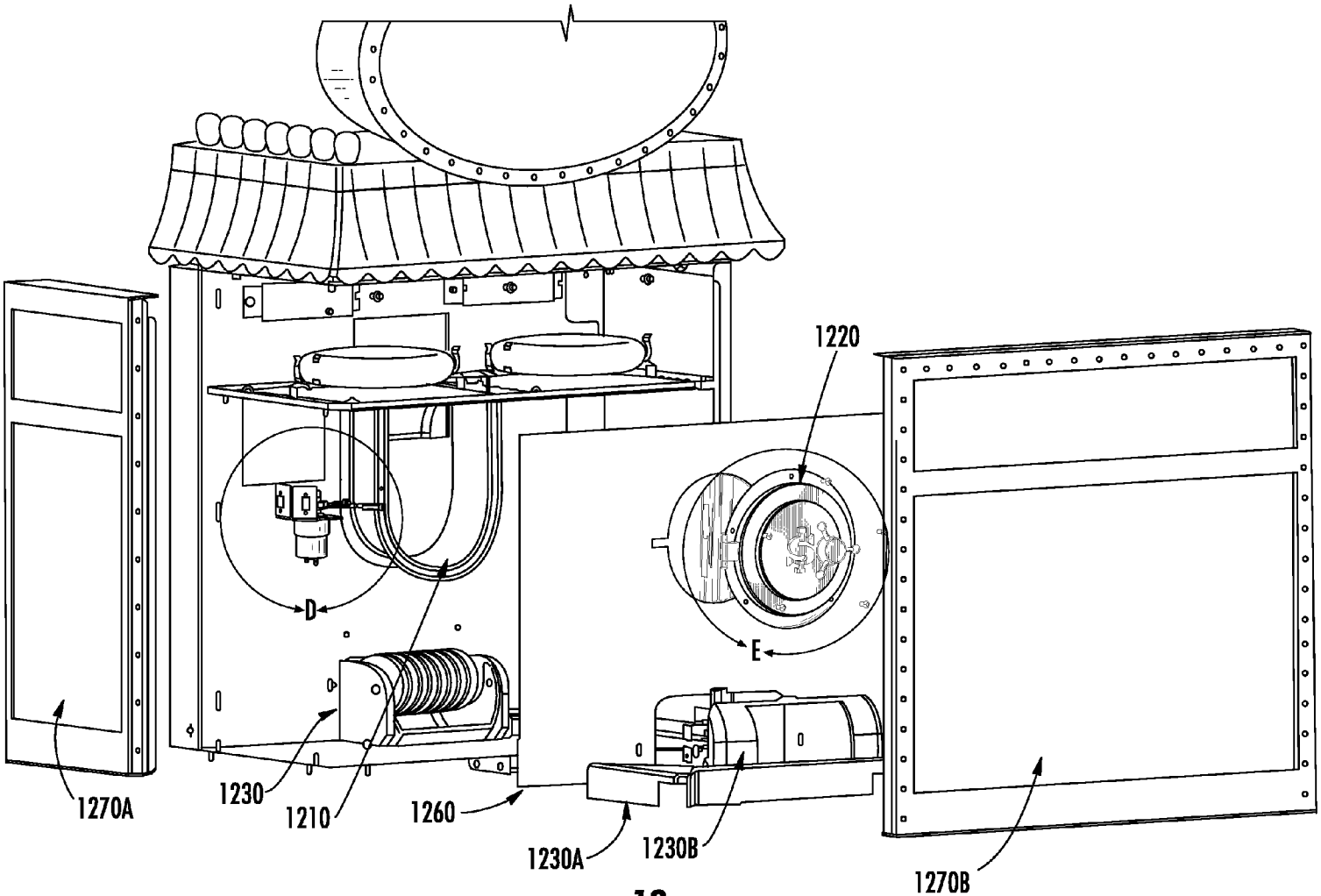
FIG. 18 is substantially an exploded front perspective view of a gaming device of the present invention showing a bank vault reservoir, a reservoir emptying mechanism (door), and a transport device for moving display objects.
Figure 19:
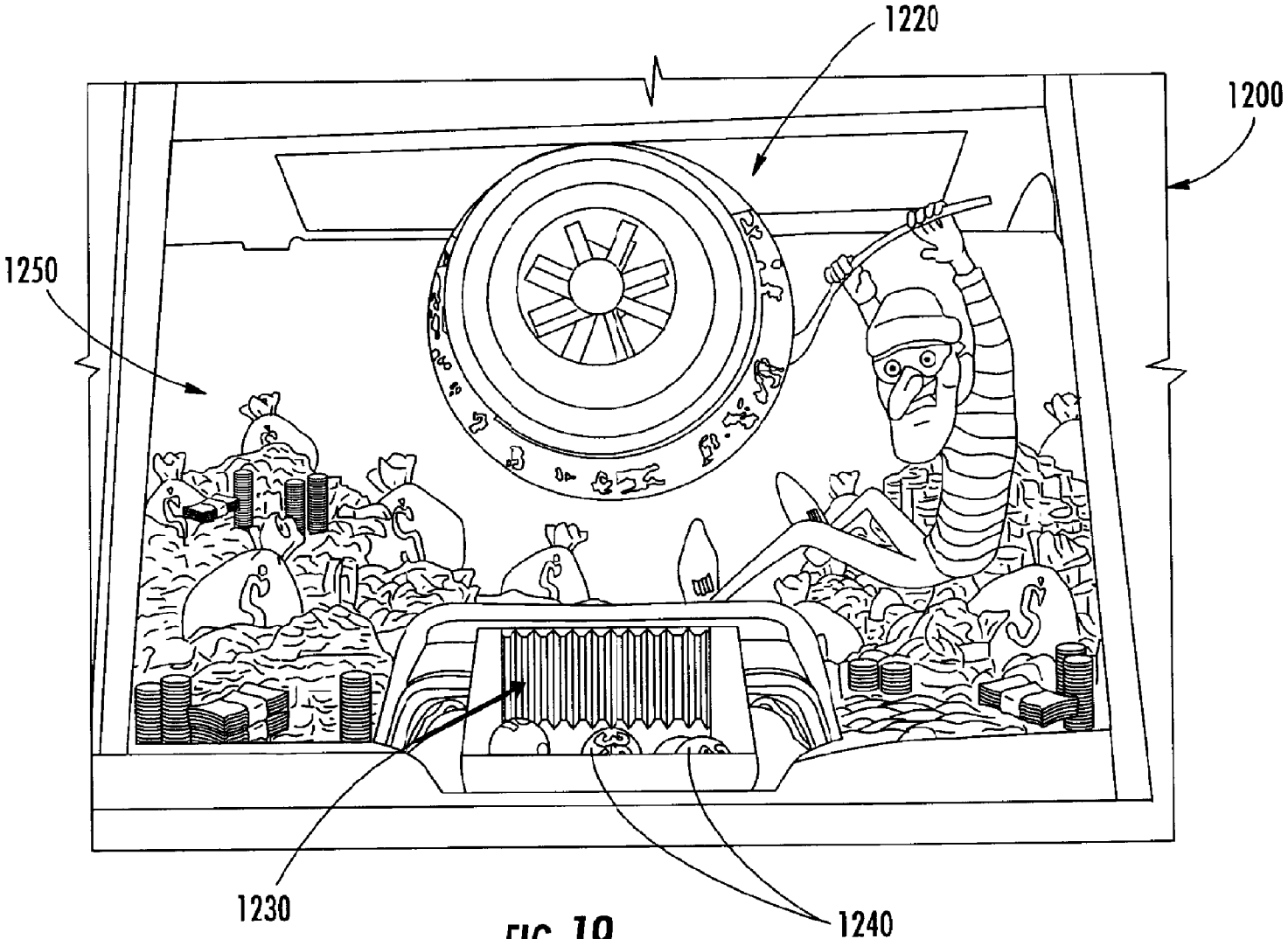
FIG. 19 is substantially an isolated front view of the bank vault reservoir embodiment.

As shown in FIG. 18, the gaming device may include a reservoir 1210 (shown here in at least a partial bank vault shape) for display objects, a reservoir emptying mechanism 1220 (vault door), and a transport device 1230 for moving the display objects to the reservoir 1210. FIG. 19 is a further representation of the bank vault embodiment (isolated view inside housing 1200) including display objects 1240 (display balls) in a display area 1250, a reservoir emptying mechanism 1220 (bank vault door), and a display object transport device 1230; see FIG. 18 for relative positioning of these elements within housing 1200.

Referring back to FIG. 18, this exploded view shows transport device 1230 including a drive roller (powered by a motor, not shown). Transport device 1230 moves display objects 1240 from display area 1250 (see FIG. 19) to bank vault reservoir 1210 (FIG. 18). Display object feed tray 1230A and transport device cover 1230B provide other aspects of the transport device apparatus. Transport device 1230 may typically include direct current (d.c.) motor 1230C and drive rollers 1230D (see FIG. 25). False wall 1260 hides details of the reservoir emptying mechanism (bank vault door 1220) and movement of the display objects. Protective viewing shields for display housing 1200 are provided in the form of side and front shields 1270A and 1270B, respectively.

One type of reservoir 1210 includes enclosed containers (shown in FIG. 19), for example, containers that include an opening (such as a door, gate or lid corresponding to reservoir emptying mechanism 1220) that may closed to retain display objects 1240 therein or opened to allow display objects 1240 to exit. Suitable enclosed containers for use in the present invention include, for example, bank vaults (safes), storage chests, coffers, trunks and strongboxes. One type of chest would include a treasure chest, for example.

Figure 20:
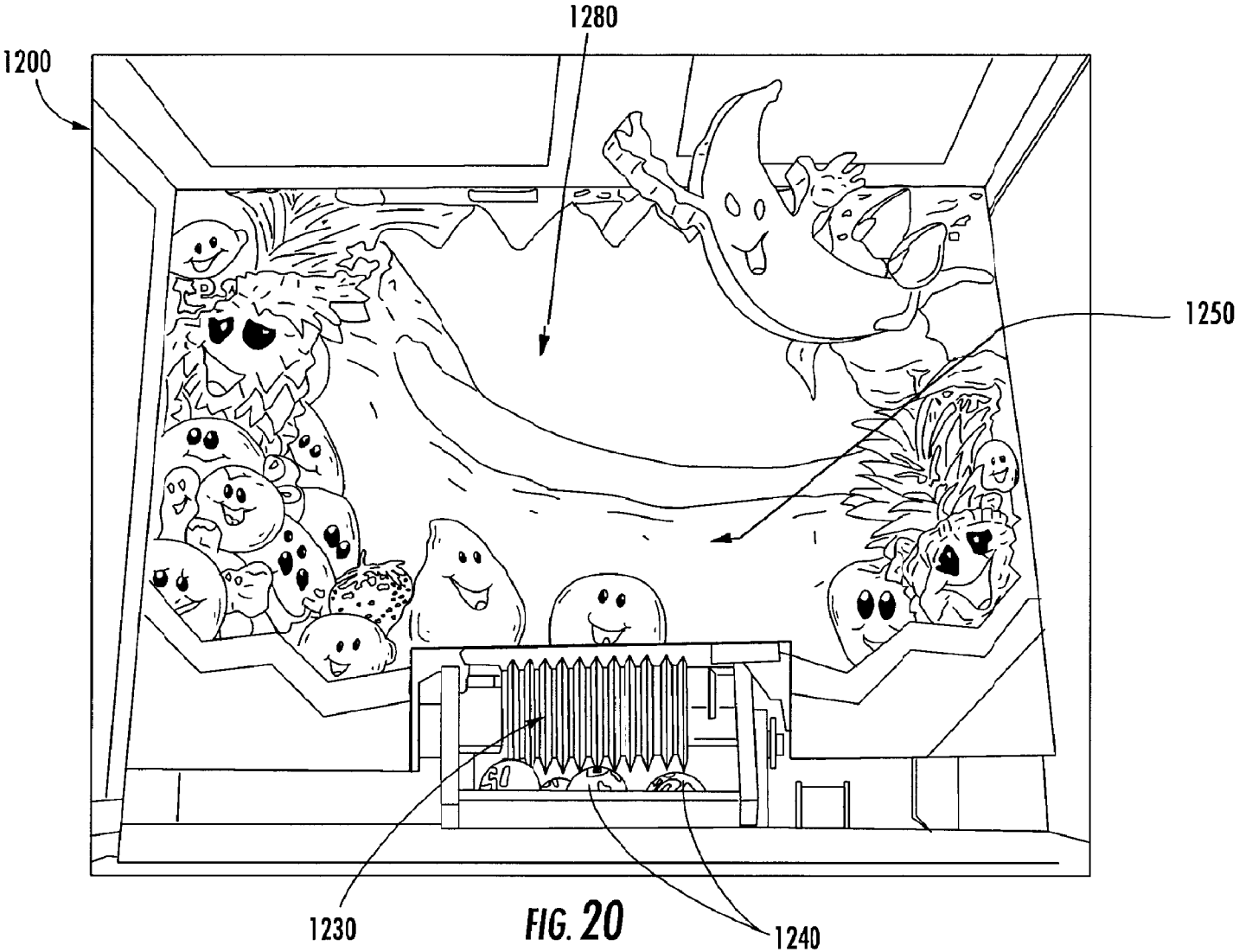
FIG. 20 is substantially an isolated front view of a melon-shaped reservoir embodiment.

Another form of reservoir for holding display objects includes open-top containers, such as that shown in FIG. 20. Suitable open-top containers for use in the present invention include, for example, buckets, kettles, pots and melon-shaped vessels having the upper portion carved away (such as one-half of a watermelon). In this case, the reservoir 1280 includes at least a partial melon shape configured to hold display objects; display objects may be configured to simulate various types of fruit. When the reservoir is in the form of a open-top container, reservoir 1280 may be configured to be rotatable about a horizontal axis so that reservoir 1280 may be tilted about the horizontal axis (not shown) to cause display objects held in the reservoir to fall out of the reservoir. In this case, a reservoir emptying mechanism (not shown) may include a lever arm and actuator configured to tilt reservoir 1280; suitable actuators include, for example, solenoids and motors. The rotation/tilt mechanism may also be used in conjunction with reservoirs of the enclosed-container type. For example, when reservoir 1210 is in the form of a treasure chest, the reservoir emptying mechanism 1220 may correspond to the lid of the treasure chest and the rotation/tilt mechanism described above may be used to tilt the treasure chest so that display objects 1240 fall from the treasure chest reservoir; this embodiment may then simulate the action of treasure (such as coins or jewelry) falling from the treasure chest.

It is understood that the reservoir emptying mechanisms useful in the present invention may be provided in a variety of forms in addition to the doors (hinged or sliding), gates and rotation/tilt devices described above. Other suitable reservoir emptying mechanisms include, for example, hinged or sliding plates, panels, screens and telescoping (extension) rods or bars.

When display objects 1240 fall from reservoir 1210 or 1280 they accumulate in a collection area in the bottom of display area 1250 (see FIGS. 19-20). In the collection area, display objects 1240 may be gravity fed into transport device 1230. Suitable transport devices (and the operation thereof) include those previously discussed regarding FIGS. 9-14, that is, conveyor belts, discs, rollers, wheels, lifts, claws and augers. For example, the transport device may include a conveyor belt configured to transport the display objects in a substantially vertical direction; alternatively, the transport device may include a display object feed chute (1230E) and a display object drive roller 1230D (see FIG. 25). The transport device may further include at least one transport component (similar to those previously discussed regarding FIGS. 13, 14 and 15A-15D) such as, for example, cups, bowls, scoops, buckets, ledges, shovels and blades, cooperating with the transport device and configured to receive the display objects. For example, the transport device may include an auger where the transport component is a helical blade.

Figure 21:
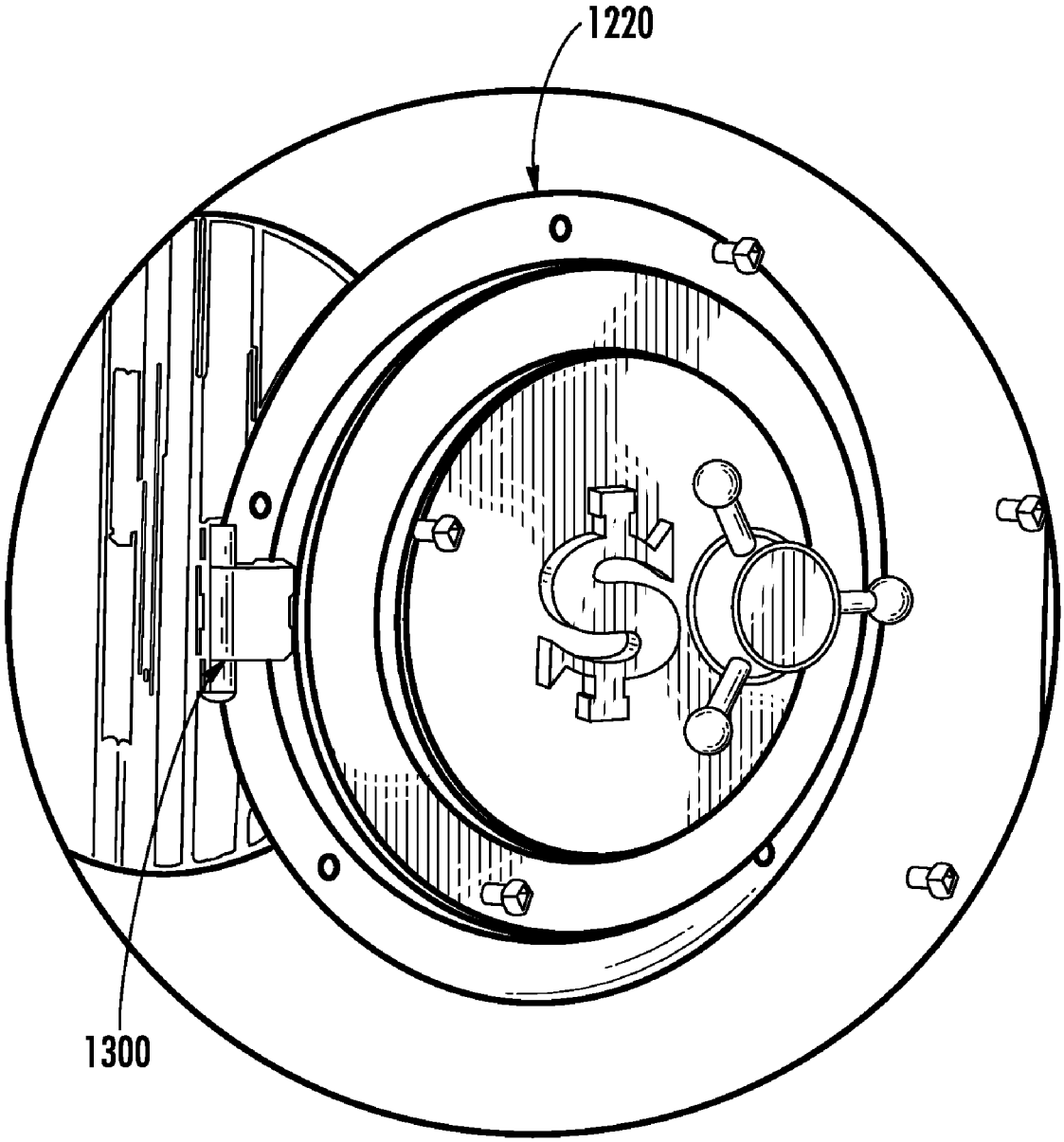
FIG. 21 is substantially a detailed view of the bank vault door reservoir emptying mechanism (area E of FIG. 18).
Figure 22:
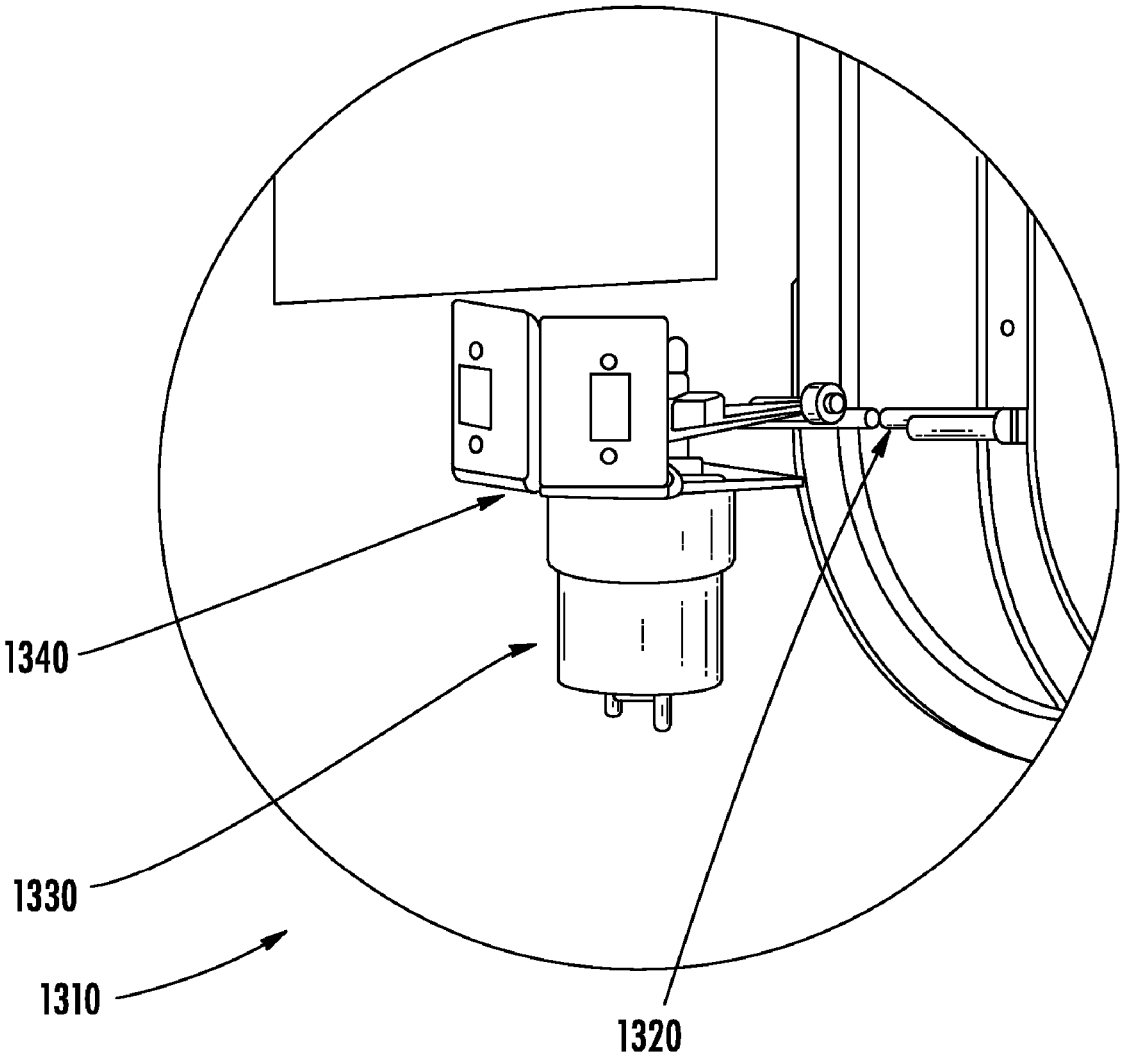
FIG. 22 is substantially a detailed side view of an actuator mechanism associated with the reservoir emptying mechanism (area D of FIG. 18).

An enlarged view of reservoir emptying mechanism 1220 (bank vault door of FIGS. 18-19) is shown in FIG. 21; the reservoir emptying mechanism may involve a gate or door, for example. Hinge and pin device 1300 attaches vault door 1220 to reservoir 1210. An actuator mechanism 1310 (side view shown in FIG. 22) is coupled to the reservoir emptying mechanism 1220; the actuator mechanism 1310 is configured to activate/deactivate the reservoir emptying mechanism 1220 (vault door) to open and close, thus causing the display objects to fall out of the reservoir (open position) or retaining the display objects within the reservoir (closed position). Actuator mechanism 1310 typically includes an actuator arm 1320 and d.c. drive motor 1330. Actuator mechanism 1310 may further include optic devices 1340 which are able to sense the relative open/closed position of the reservoir emptying device 1220 (vault door).

Figure 23:
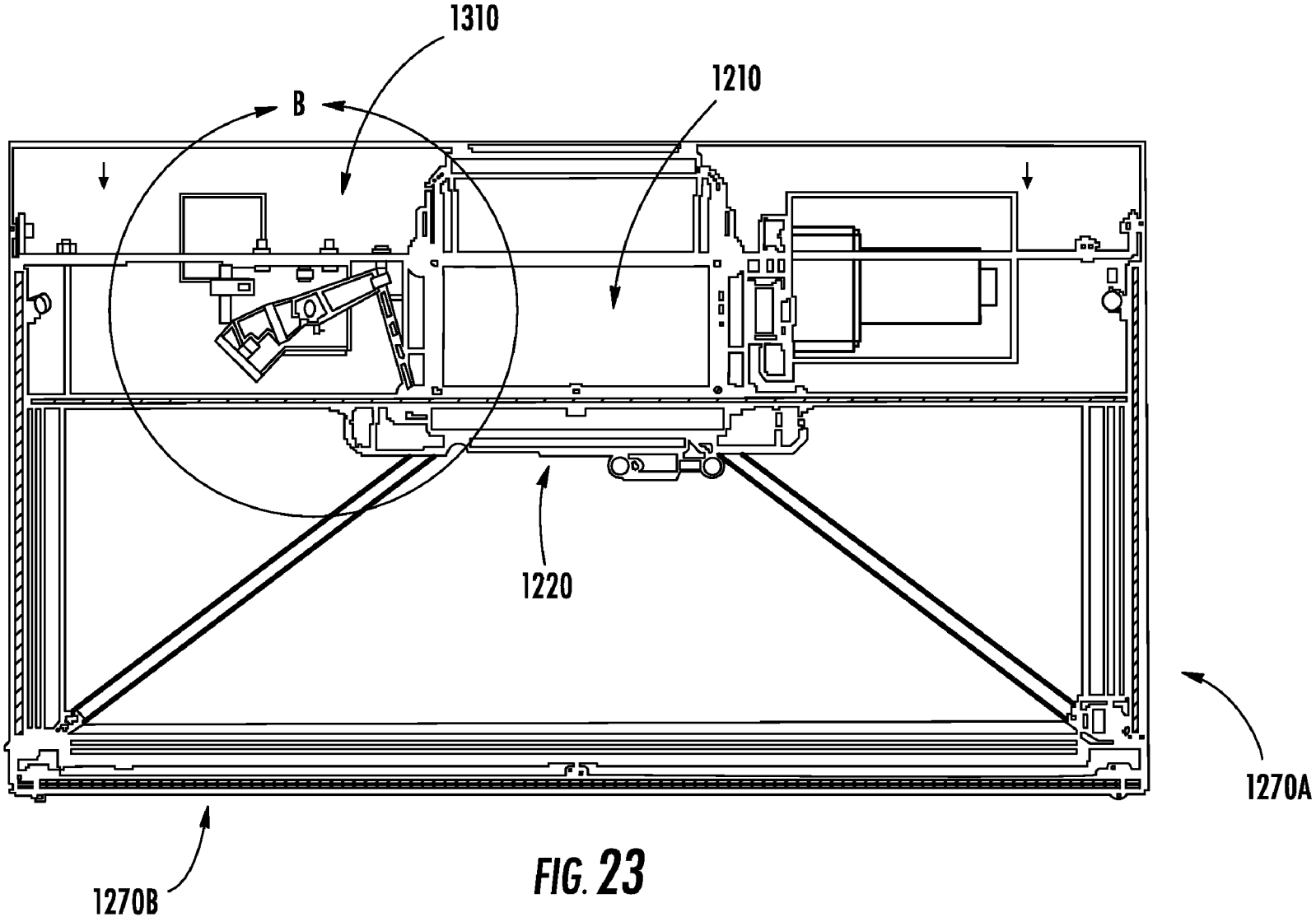
FIG. 23 is substantially a top cross sectional view of the display housing taken along line A-A of FIG. 17B.
Figure 24:
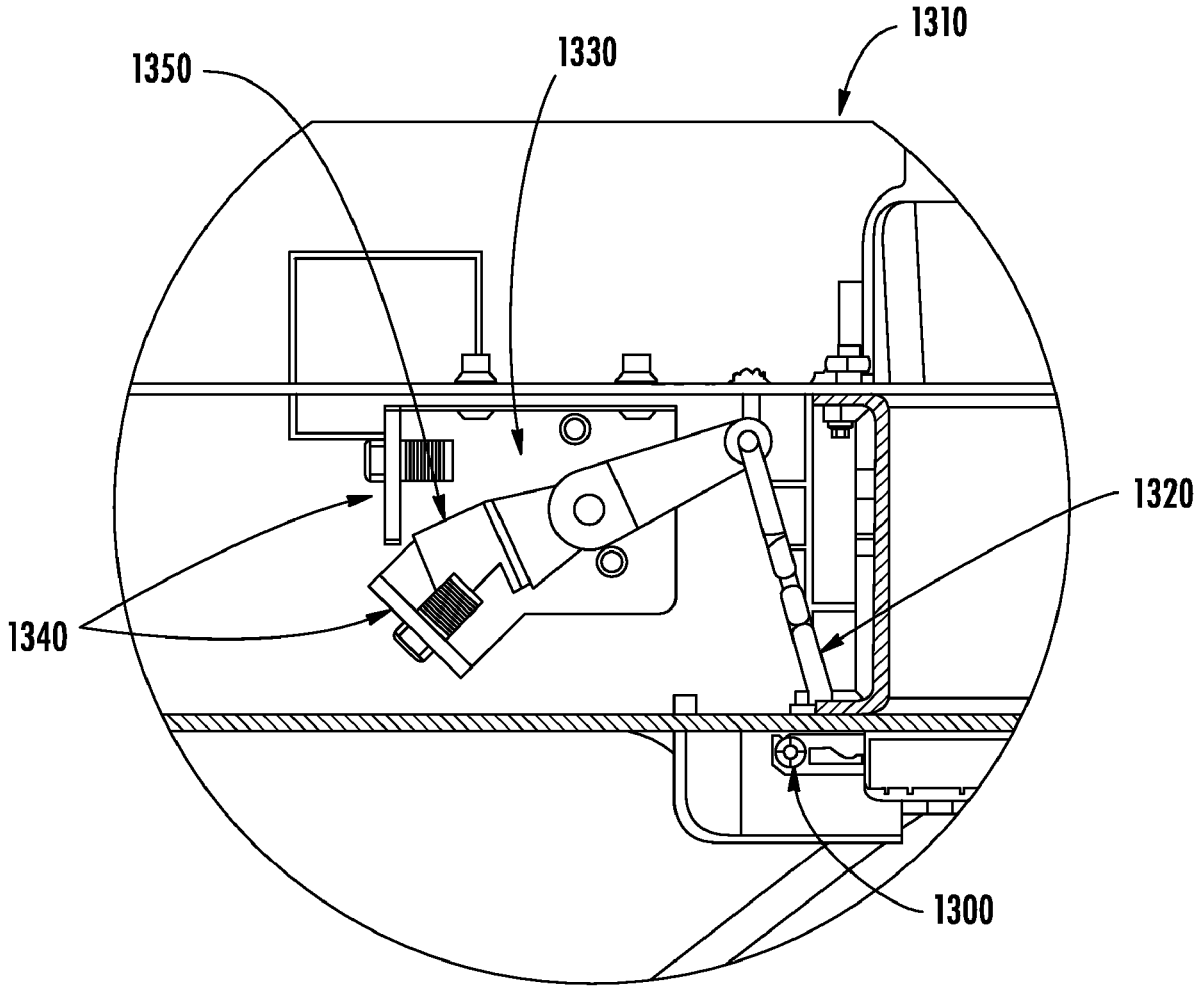
FIG. 24 is substantially a detailed top view of the actuator mechanism associated with the reservoir emptying mechanism (area B of FIG. 23).

Another view (top) of actuator mechanism 1310 is shown in FIGS. 23 and 24. FIG. 23 shows actuator mechanism 1310 in relationship to reservoir 1210 (bank vault) and reservoir emptying mechanism 1220 (vault door), whereas FIG. 24 shows an enlarged detailed top view of the components of actuator mechanism 1310. Actuator arm 1320 is shown in relationship to hinge and pin device 1300 (see side view in FIG. 21) and is coupled to d.c. drive motor 1330. An encoding device 1350 may be used to activate optic devices 1340 (FIG. 22) which sense the position of the reservoir emptying device 1220 (vault door).

Figure 17B:
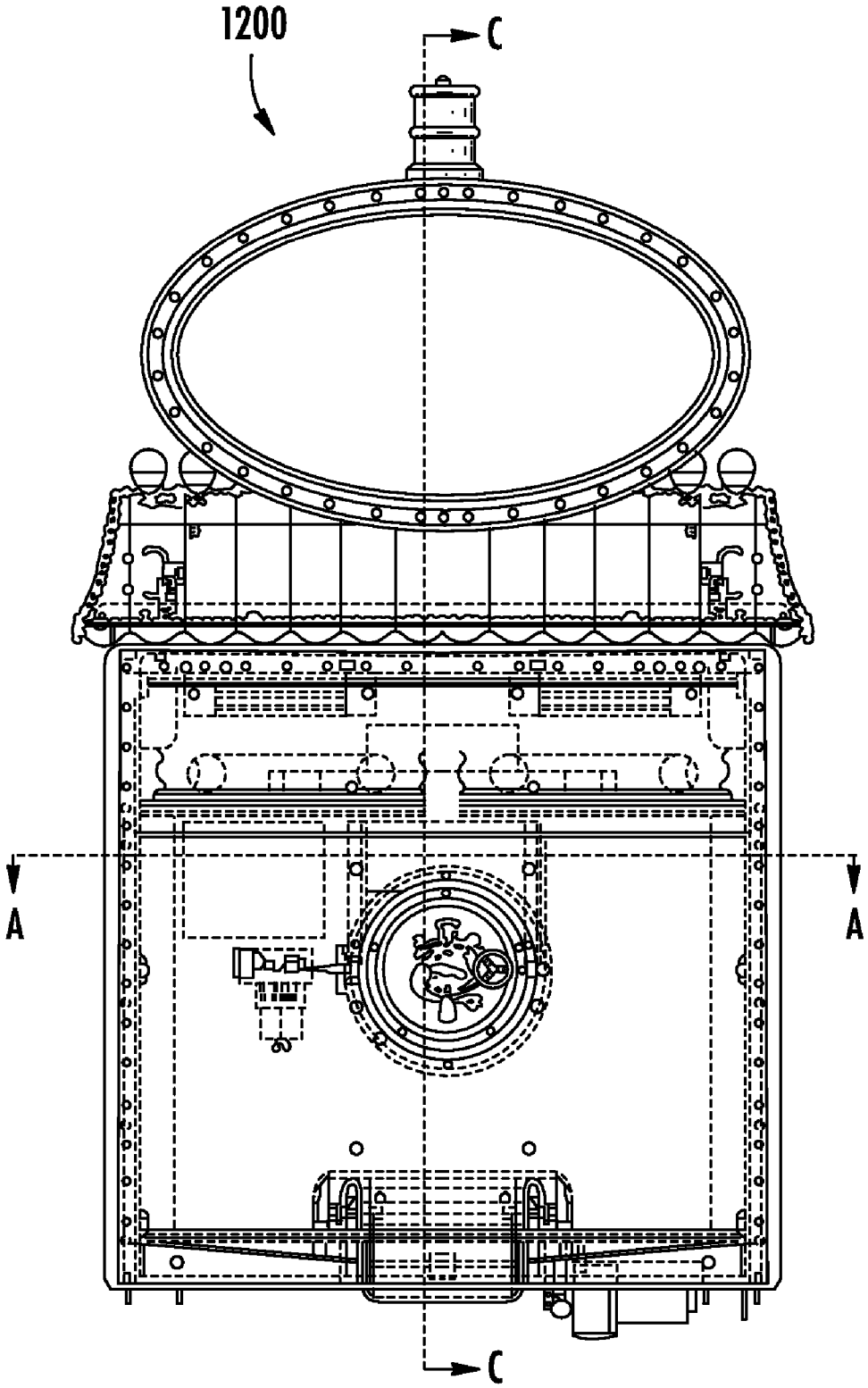
FIG. 17B is substantially a front view of the display housing of FIG. 17A showing cross section lines A-A and C-C.
Figure 25:
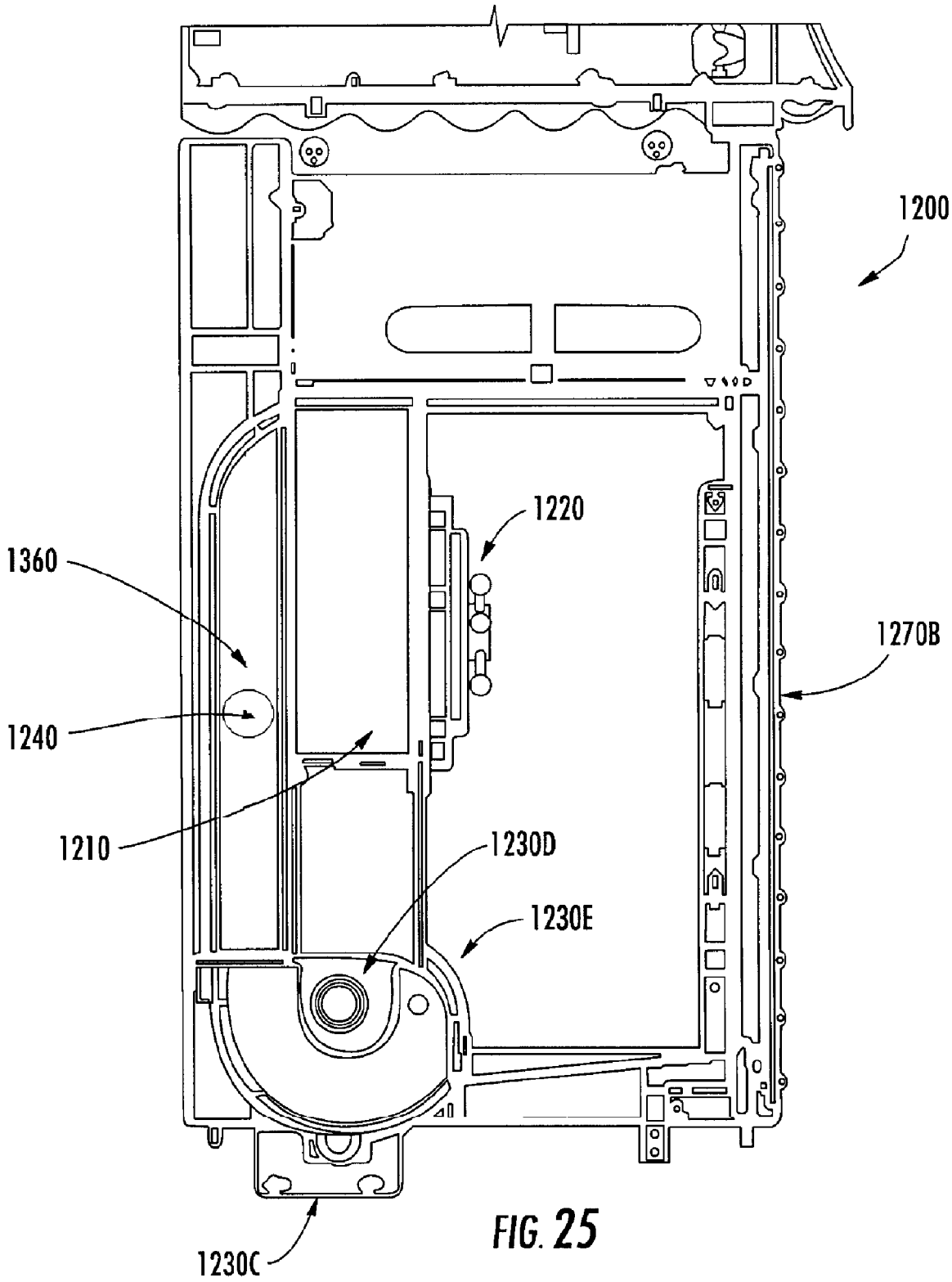
FIG. 25 is substantially a side cross sectional view of the display housing taken along line C-C of FIG. 17B.

The travel path of display objects 1240 can be followed in the side cross sectional view (see FIG. 17B) of display housing 1200 shown in FIG. 25. Transport device 1230 includes d.c. motor 1230C, drive roller 1230D and display object feed chute 1230E. Display objects 1240 are moved up display object chute 1360 where they may be deposited into reservoir 1210.

Gaming devices of the present invention may further provide a base game cycle or a bonus game cycle similar to that previously discussed in relation to FIGS. 1A and 2A and similar to that presented in the flowchart of FIG. 16. In the case of the present invention and for the purposes of the following discussion however, it is understood that the jumbled ball display 12 of the gaming device 10 in FIG. 1A would be replaced by the display housing 1200 and related components of FIGS. 17A-18.

Figure 26:
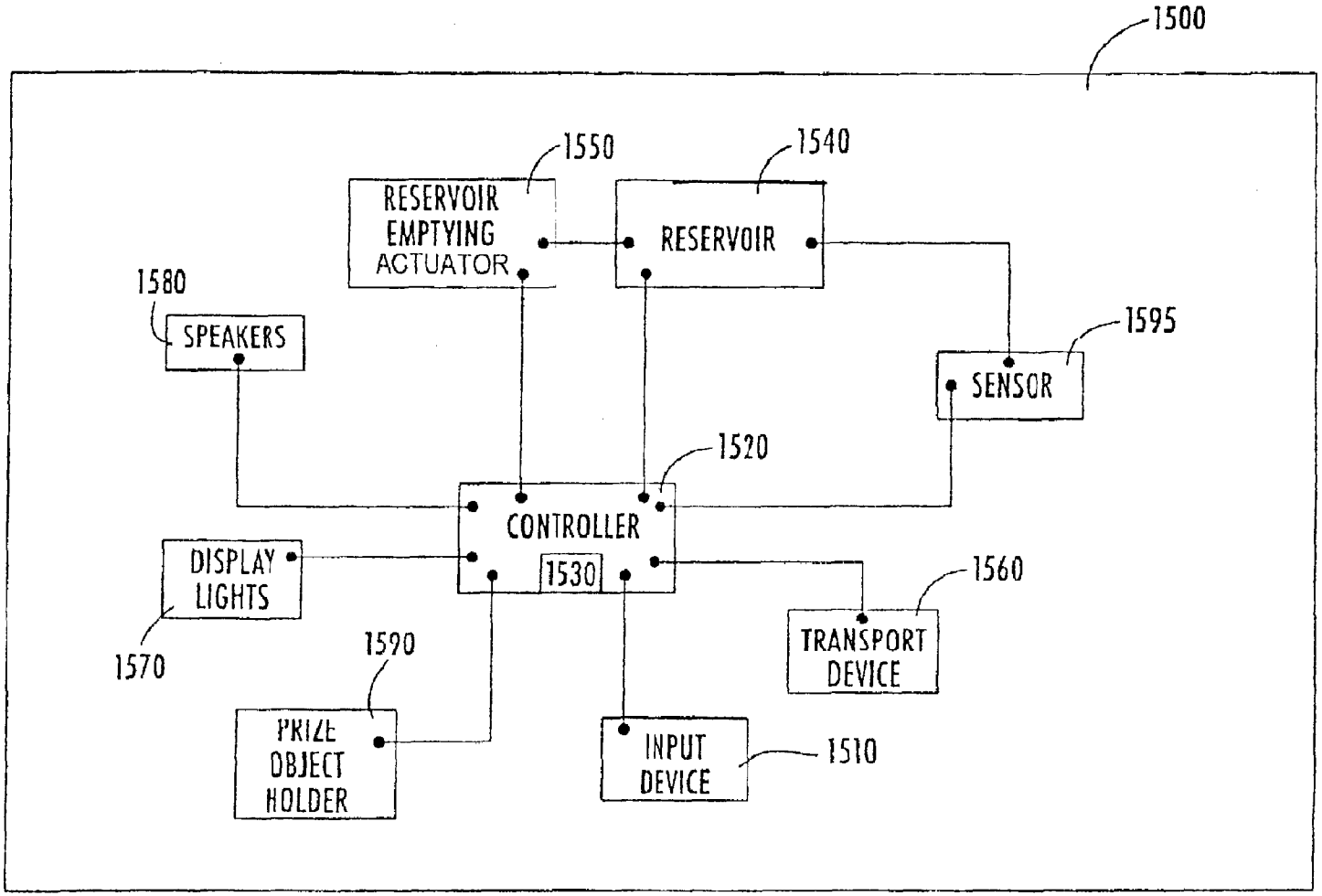
FIG. 26 is substantially a schematic representation of components of a gaming device of the present invention.

As shown in the schematic outline in FIG. 26, the gaming device 1500 of the present invention may include a controller 1520 which is configured to control the gaming device 1500 by utilizing a random number generator 1530 to produce random or pseudo random numbers for each base game or bonus game cycle. The outcome of a base game or a bonus game may be determined similarly to that previously presented in the discussion of FIG. 16, for example. Controller 1520 is provided in communication with (a) reservoir 1540 (and associated reservoir emptying mechanism, such as, for example, 1220 in FIG. 18), (b) reservoir emptying actuator 1550, (c) input device 1510 (for example, a button, a keyboard or a touch screen display, such as that corresponding to 90 of FIG. 1A or button(s) 1014 of selection panel 1113 in FIG. 8), which may be configured to allow a player to select one or more symbols during a bonus game cycle, and (d) display object transport device 1560 (such as, for example, 1230 in FIGS. 18-20). Controller 1520 is configured to activate and deactivate the transport device 1560, to activate and deactivate the reservoir emptying actuator 1550, to detect any symbol(s) that optionally may be selected by a player, to display any selected symbols, to terminate the game and to award a prize to the player. The controller 1520 may be one or more computers (not shown) or processor boards (not shown), and the controller 1520 generally is configured to communicate with a display light(s) 1570 and a speaker(s) 1580 for visual and sound effects, and may be in communication with a prize object holder 1590 for randomly selecting at least one or more prize objects.

Controller 1520 may be configured to detect when reservoir 1540 contains various amounts of display objects. For example, a sensor 1595 in communication with controller 1520 may also be associated with the reservoir 1540, whereby controller 1520 is configured to detect when a predetermined amount of display objects are in reservoir 1540. The game may then be terminated at various stages of "fullness" of the reservoir, thus corresponding to different types of prizes to be awarded to a player. In a related embodiment, controller 1520 may be in communication with display object transport device 1560 where controller 1520 is configured to terminate movement of the display objects from the display area to reservoir 1540 after predetermined time (time out mode).

Alternatively, controller 1520 may communicate with reservoir emptying actuator 1550 such that display objects may be continuously transported to reservoir 1540 while the reservoir emptying mechanism (door, gate or rotation/tilt mechanism) associated with reservoir 1540 is in an "emptying" mode. In this fashion, the display objects would appear to fall from reservoir 1540 in a continuous flow rather than in a one-time-only "flood" manner as previously described. In a further embodiment, game play may include allowing the player the appearance of controlling when reservoir emptying actuator 1550 may be activated to "empty" display objects from reservoir 1540; this form of player "selection" is similar to that previously described (see, for example, discussion relating to FIG. 16).

Controller 1520 also may be configured to generate and to detect when a bonus qualifying event occurs for activation of a bonus game cycle, which will include activating transport device 1560 and determining which symbol(s) to display to the player via the random number generator 1530. For example, in an alternative use of sensor(s) 1595, the controller 1520 can detect and stop reels 22-24 (FIG. 1A) on gaming apparatus 20 when the symbols are in the desired position. When reels 22-24 (FIG. 1A) are in a bonus activating event position, the controller 1520 will sense this position and begin the bonus game cycle. Sensor(s) 1595 may also be provided external to the gaming device 1500 to detect external bonus activating events. The controller 1520 may also transmit and/or detect a variety of other information, such as when coins (not shown) or currency (not shown) have been inserted into a wage acceptor (such as 21 or 25 in FIG. 1A), when a game starts, when an error has occurred or when a sensor detects tampering.

Alternatively, when the controller 1520 detects a bonus activating event, it may begin the bonus game cycle by activating, for example, the transport device 1560, video screen(s) (not shown), display lights 1570 or light emitting diodes (not shown). These devices may indicate that a player has qualified for the bonus game cycle and may prompt the player to perform an action. During the bonus game cycle, transport device 1560 transports the display objects from a display area to reservoir 1540, for example as shown in FIG. 19 (from transport device 1230 to reservoir behind vault door 1220) and in FIG. 20 (from transport device 1230 to reservoir 1280).

The base/bonus game cycle ends when the controller 1520 deactivates transport device 1560 (such as 1230 in FIGS. 18-20), transporting of display objects is stopped and the display objects are emptied out of the reservoir 1540 by activation of reservoir emptying actuator 1550. The winning base/bonus game result is communicated to the player by presentation of a prize object in a second display area of gaming device 1500.

Communication of the winning base/bonus game result involves prize object holder 1590, generally associated with a second display area of gaming device 1500, separate from the first display area (associated with reservoir 1540). Prize object holder 1590 (not shown in FIGS. 17A-20) typically maybe used in conjunction with the reservoir 1540 (such as such as bank vault reservoir 1210 or melon-shaped reservoir 1280). More specifically, prize object holder 1590 associated with the second display area may include any type of prize object, for example, keno balls, ping-pong balls or rubber balls, associated with a base game or bonus game cycle payout.

Game play operation involving use of prize object holder 1590 (and corresponding second display area) is similar to that previously presented in the discussion regarding FIGS. 2A, 3 and 4, for example. At least one of the prize objects has a symbol that is capable of indicating a prize to be awarded to the player. Prize objects are stored in prize object holder 1590 in an individually controlled manner so that individual prize objects may be selectively removed from the prize object holder, thus allowing specific prize objects with particular symbols or values to be individually manipulated and displayed when desired; for example, the prize holder arrangement may further include a display mechanism configured to selectively display at least one prize object to the player. In one embodiment, multiple prize objects may be displayed, making it possible to use combinations of prize objects to indicate various bonus outcomes. After controller 1520 has determined which prize object(s) is to be displayed, the controller may rotate the prize object holder 1590 until the desired prize object (for example, a ball bearing game-related indicia) is positioned to be visible to the player in the second display area. In this fashion, the player may be shown a base game/bonus game prize in the second display area as a result of emptying of reservoir 1540.

Figure 27:
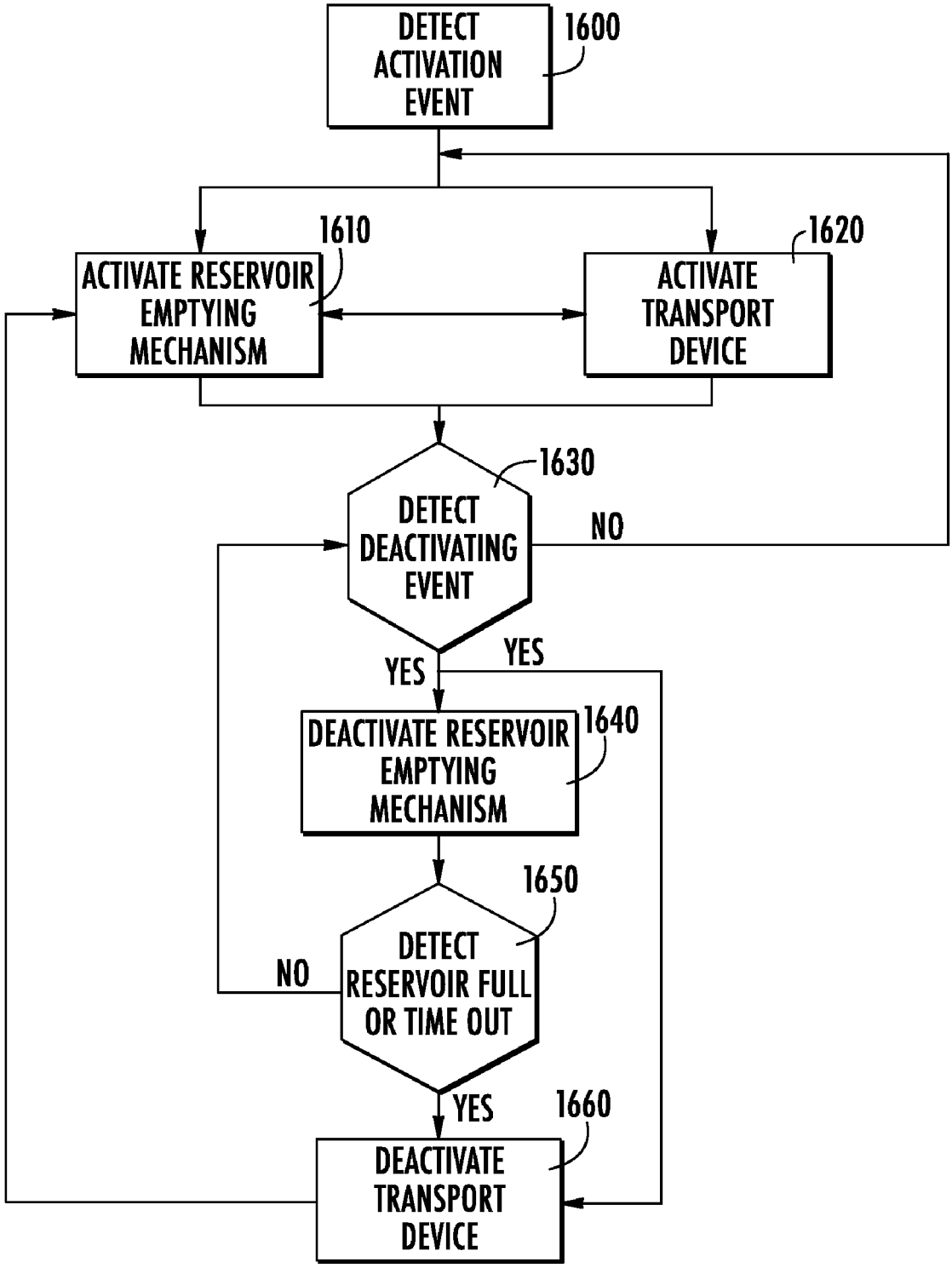
FIG. 27 is substantially a flowchart of a gaming method of the present invention

FIG. 27 illustrates one method of playing the gaming device 1500 of the present invention wherein an activation event is detected (step 1600), such as, for example, initiation of a primary base game, occurrence of a bonus activating/qualifying event or player input; this is followed by appropriate game events. Activation of the reservoir emptying mechanism (step 1610) and activation of the display object transport device (step 1620) may occur simultaneously or separately from each other depending on the particular display/game mode that is involved. For example, when step 1610 occurs before, or simultaneously with, step 1620, display objects transported to the reservoir will fall out the reservoir in a continuous fashion. However, when step 1620 occurs before step 1610, display objects will be transported to the reservoir and stored there until the reservoir emptying mechanism is activated (step 1610); in this case, the display objects may fall out of the reservoir in a one-time flood fashion A game or display mode may be continued as described above unless a deactivating event is detected (step 1630); deactivating events may include, for example, player input or a predetermined time out. If no deactivation event is detected, the method loops back to steps 1610/1620. If deactivation of the reservoir emptying mechanism is detected (step 1640), such as closing the bank vault door, for example, the method proceeds to step 1650 to determine if the reservoir is full or a predetermined time out has occurred. If the reservoir is not full or no predetermined time out has occurred, then the method loops back to step 1630. If the reservoir is detected to be full or that a predetermined time out has occurred, then the display object transport device is deactivated at step 1660 and the method proceeds to step 1610. Alternatively, at step 1630, if deactivation of the display object transport device is detected (step 1660), steps 1640 and 1650 may be bypassed.

There are other features and advantages of one or more the various embodiments. They should be apparent to those skilled in the art based on the disclosure above. This may be accomplished in different ways.

Although the description above contains many specifications, these should not be construed as limiting the scope of the invention but as merely providing illustrations of some of the presently preferred embodiments of this invention. This specification above, for instance, makes reference to bonus prizes. However, the present invention is not thereby intended to be limited to providing bonus prizes; rather it is intended that the present invention can, in certain embodiments, be used independently as a stand-alone game without necessarily including bonus game play. Thus, the scope of the invention should be determined by the claims as issued and their legal equivalents rather than by the examples given.

Accordingly, the present invention provides a gaming device including a reservoir for holding display objects, a reservoir emptying mechanism for causing the display objects to fall out of the reservoir, and an actuator mechanism for activating the emptying mechanism. The reservoir of the gaming device may simulate a bank vault where the display objects further simulate coins as they fall out of the bank vault. Not only is the gaming device exciting and enjoyable to play, it also increases the length of play experienced by players.

Although the description above contains many specifications, these should not be construed as limiting the scope of the invention but as merely providing illustrations of some of presently preferred embodiments of this invention. Thus, the scope of the invention should be determined by the appended claims and their legal equivalents rather than by the examples given.

We claim:

1. A gaming device comprising:

(A) a plurality of display objects;

(B) a reservoir configured to hold at least one display object;

(C) a reservoir emptying mechanism associated with the reservoir, the emptying mechanism being configured to cause the display objects to fall out of the reservoir;

(D) an actuator mechanism coupled to the reservoir emptying mechanism, the actuator mechanism being configured to activate the reservoir emptying mechanism to cause the display objects to fall out of the reservoir;

(E) a controller in communication with the actuator mechanism, the controller being configured to activate the actuator mechanism;

(F) a plurality of prize objects;

(G) a prize object holder configured to hold the prize objects in an individually controlled manner; and (H) a display mechanism associated with the prize object holder and configured to selectively display at least one prize object to a player.

2. The gaming device of claim 1 wherein the reservoir emptying mechanism comprises a gate, wherein when the gate is in a closed position, the display objects may be held in the reservoir, and when the gate is in an open position, display objects held in the reservoir may fall out of the reservoir into a display area.

3. The gaming device of claim 1 wherein the reservoir comprises at least an enclosed container.

4. The gaming device of claim 3 wherein the enclosed container is selected from the group consisting of a bank vault, a storage chest, a coffer, a trunk and a strongbox.

5. The gaming device of claim 1 wherein the reservoir comprises at least an open-top container.

6. The gaming device of claim 1 wherein the reservoir is rotatable about a horizontal axis and the reservoir emptying mechanism comprises a lever arm and actuator configured to tilt the reservoir about the horizontal axis to cause display objects held in the reservoir to fall out of the reservoir.

7. The gaming device of claim 1 further comprising a display area and a display object transport device configured to move the display objects from the display area to the reservoir.

8. The gaming device of claim 7 further comprising a sensor associated with the reservoir and in communication with the controller, the sensor being configured to detect when a predetermined amount of display objects are in the reservoir.

9. The gaming device of claim 7 further comprising the controller in communication with the display object transport device, the controller being configured to terminate movement of the display objects from the display area to the reservoir after a predetermined time.

10. The gaming device of claim 7 wherein the display object transport device is selected from the group consisting of conveyor belts, discs, rollers, wheels, lifts, claws and augers.

11. The gaming device of claim 10 wherein the display object transport device comprises a conveyor belt and is configured to transport the display objects in a substantially vertical direction.

12. The gaming device of claim 10 wherein the transport device comprises a display object feed chute and a display object drive roller.

13. The gaming device of claim 10 wherein the transport device further comprises at least one transport component configured to receive the display objects and wherein the at least one transport component is selected from the group consisting of cups, bowls, scoops, buckets, ledges, shovels and blades.

14. The gaming device of claim 13 wherein the transport device comprises an auger and the at least one transport component is a helical blade.

15. The gaming device of claim 1 wherein the display objects and the prize objects are separate and distinct from each other.

16. A gaming device comprising:

(A) a first display area comprising:

(i) a plurality of display objects;

(ii) a reservoir configured to hold at least one display object;

(iii) a reservoir emptying mechanism associated with the reservoir, the emptying mechanism being configured to cause the display objects to fall out of the reservoir; and (iv) a display object transport device configured to move the display objects from a collection area to the reservoir; and (B) a second display area comprising:

(i) plurality of prize objects;

(ii) a prize object holder configured to hold the prize objects in an individually controlled manner;

a. a display mechanism for selectively displaying at least one prize object; and b. a controller in communication with the display mechanism, the controller being configured to select a prize object and cause the display mechanism to display the selected prize object to a player.

17. The display device of claim 16 wherein the display objects and the prize objects are located separately from each other.

18. The display device of claim 16 wherein the prize objects held in the prize object holder are hidden from view of the player.

* * * * *